US012590397B2

(12) United States Patent
Hebert

(10) Patent No.: US 12,590,397 B2
(45) Date of Patent: Mar. 31, 2026

(54) INDUSTRIAL LAUNDRY SYSTEMS AND METHODS

(71) Applicant: Decon Water Technologies, LLC, Chandler, AZ (US)

(72) Inventor: Marten Hebert, Phoenix, AZ (US)

(73) Assignee: Rochester Midland Corporation, Rochester, NY (US)

( * ) Notice: Subject to any disclaimer, the term of this patent is extended or adjusted under 35 U.S.C. 154(b) by 286 days.

(21) Appl. No.: 17/723,810

(22) Filed: Apr. 19, 2022

(65) Prior Publication Data

US 2022/0333289 A1 Oct. 20, 2022

Related U.S. Application Data

(60) Provisional application No. 63/176,793, filed on Apr. 19, 2021.

(51) Int. Cl.
*D06F 39/02* (2006.01)
*D06F 39/08* (2006.01)
(Continued)

(52) U.S. Cl.
CPC ..... *D06F 39/022* (2013.01); *D06F 39/028* (2013.01); *D06F 33/34* (2020.02); *D06F 33/37* (2020.02); *D06F 39/02* (2013.01); *D06F 39/08* (2013.01); *D06F 39/088* (2013.01); *D06F 2105/42* (2020.02)

(58) Field of Classification Search
CPC ..... D06F 33/34; D06F 33/37; D06F 39/02; D06F 39/022; D06F 39/028; D06F 39/08; D06F 39/088; D06F 2105/42
See application file for complete search history.

(56) References Cited

U.S. PATENT DOCUMENTS 3,595,438 A * 7/1971 Daley ..... B01F 21/221 222/67
4,063,663 A * 12/1977 Larson ..... B01F 21/22 222/67
(Continued)

FOREIGN PATENT DOCUMENTS

CA 2313356 1/2001
CN 101046043 A 10/2007
(Continued)

OTHER PUBLICATIONS

Smither, F.W. "Washing, Cleaning, and Polishing Materials" U.S. Department of Commerce, National Bureau of Standards. Circular C242, 73 pages, 1939.
(Continued)

*Primary Examiner* — Joseph L. Perrin
(74) *Attorney, Agent, or Firm* — King IP Law; Joshua King

(57) ABSTRACT

A system and method of cleaning laundry in a washing vessel. A container is configured to hold a chemical that is granular and suitable for cleaning laundry. A tank receives the chemical from the container and a solvent to form a solution that includes undissolved chemical. The chemical can be an oxidant chemical and the solution can be saturated. A washing vessel that holds laundry is fluidly connected to the tank and a water source. The washing vessel receives the solution with undissolved chemical and another solvent to clean the laundry.

11 Claims, 11 Drawing Sheets

(51) Int. Cl.

| | |
|---|---|
| *D06F 33/34* | (2020.01) |
| *D06F 33/37* | (2020.01) |
| *D06F 105/42* | (2020.01) |

(56) References Cited

U.S. PATENT DOCUMENTS

| | | | | |
|---|---|---|---|---|
| 4,110,075 | A | 8/1978 | Graf et al. | |
| 5,431,836 | A | 7/1995 | Carr et al. | |
| 9,926,520 | B2 | 3/2018 | Panandiker et al. | |
| 2006/0014655 | A1 | 1/2006 | Smets et al. | |
| 2013/0263387 | A1* | 10/2013 | Aykroyd | D06F 34/08 8/137 |
| 2013/0283542 | A1* | 10/2013 | Jenkins | C11D 7/02 510/276 |
| 2014/0033445 | A1 | 2/2014 | Daniels et al. | |
| 2014/0231363 | A1* | 8/2014 | Barrado Franco | A47L 15/42 312/228 |
| 2014/0312069 | A1* | 10/2014 | Livingston | A47L 15/44 222/145.1 |
| 2017/0114310 | A1* | 4/2017 | Schmiedel | C11D 17/0021 |
| 2019/0136441 | A1* | 5/2019 | Cooke | D06F 39/022 |

FOREIGN PATENT DOCUMENTS

| | | | |
|---|---|---|---|
| CN | 104562566 | A | 4/2015 |
| KR | 20160086703 | A | 7/2016 |

OTHER PUBLICATIONS

Softrol Total Plant Management "Chemical Systems", document created May 18, 2017, downloaded Nov. 21, 2025 from https://softrol.com/brochures/, 4 pages.

Ecolab, ELADOS Pump Rack, document created Mar. 6, 2019, downloaded Nov. 21, 2025 from https://en-be.ecolab.com/offerings/elados-pump-rack-eu, 1 page.

International Search Report and Written Opinion relating to International Patent Application No. PCT/US2022/025304, dated Jul. 8, 2022, 16 pages.

Ecolab, :"ULTRAX Compact," document created Mar. 6, 2019, downloaded Nov. 21, 2025 from https://en-be.ecolab.com/offerings/ultrax-compact-eu. 1 page.

Ecolab, :"ULTRAX Lite," document created Mar. 6, 2019, downloaded Nov. 21, 2025 from https://en-be.ecolab.com/offerings/ultrax-lite-eu. 1 page.

* cited by examiner

INDUSTRIAL LAUNDRY SYSTEMS AND METHODS

TECHNICAL FIELD

The disclosure relates generally to textile processing and, in particular, to industrial laundry systems and methods.

BACKGROUND

Industrial laundry systems are used to clean (dirty) laundry in bulk. For example, bed linens, bar mops, shop towels, print towels, uniforms, and tablecloths in the hospitality industry may be washed in washing machines with capacities greater than 100 lb. For example, the healthcare industry may need washing of textiles to handle contaminants and microorganisms. Such systems consume large amounts of energy and water, and issue large amounts of wastewater requiring treatment. In some cases, environmentally harmful or toxic laundry detergents may be used to achieve desired performance objectives, e.g. wash time, wash quality (cleanliness or soils removed), and energy usage. If not properly treated, the resulting wastewater can wreak havoc on human communities, animals, and ecologically sensitive areas.

Industrial systems use mass-manufactured laundry detergents in wash cycles to remove soils, including solid soils, water-soluble and hydrophobic soils, and protein and long-chain molecule soils. Examples of soils include fats, oil, non-aqueous solvents such as BTX solvents, and grease. Wash cycles stages, such as agitation (wash), rinsing, and/or spinning, serve to loosen, remove, and carry away soils. In some cases, bleach or oxidizing agents are used after soil-removing stages to treat hard-to-remove soils and stains. Oxidizers are primarily used to render colored substances colorless so that residual soils are not visible on clothing. In some cases, the oxidization process weakens adherence of residual soils to the (cloth) substrate, which facilitates removal in future wash cycles. Achieving target quality of cleanliness in the manner described may be difficult, expensive, environmentally harmful, and ecologically unsafe.

The textile washing industry has been using surfactants (e.g. non-ionic surfactants) to clean textiles under an alkaline environment for hydrocarbon-contaminated fabrics. The dominant cleaning action has been from the caustic stripping action to mobilize hydrocarbons from the material, the main emphasis of the surfactant being to solubilize the caustic liquor. Redeposition and incomplete removal of the hydrocarbons may occur. Higher dryer emissions may result as the textiles then have a higher proportional of residuals that flash off under heating for drying.

The operational and environmental costs of properly cleaning laundry using existing systems are undesirably high. Improvement is desired.

SUMMARY

Industrial laundries consume large amounts of energy, which is costly and may lead to harmful green house gas (GHG) emissions. Energy consumption is directly related to wash time, wash temperatures, and fluid properties of washing solutions.

Reducing energy consumption has often been associated with lower wash quality, i.e. greater amounts of soils left in clothes after washing and increased staining. Pre-made ("off-the-shelf") laundry detergent formulations have been suggested for reducing energy consumption without compromising wash quality, e.g. these may include specially formulated chemical compounds and enzymes. Pre-made laundry detergents include various components, such as builders, surfactants, alkalis, and enzymes, to facilitate removal of different types of soils. The components in pre-made laundry detergents are in fixed ratios and cannot be varied based on soil type and quantity. Therefore, to achieve target soil removal, dosing of pre-made laundry detergents would have to be made sufficiently large to ensure that removal of every soil type is possible in the washing solution. Significant wastage of chemical materials and/or undesirable flow behaviour and properties may result. Pre-made laundry detergents may include environmentally harmful and biologically toxic chemicals. If not properly treated, the resulting wastewater may be ecologically destructive and harmful for public health.

It is found that using raw material or chemical feedstocks (and solutions thereof) directly in washing machines may yield lower wash times, higher quality cleaning (lower soil levels on cleaned laundry), and lower wastage, as compared to pre-made laundry detergent formulations. By directly using chemical feedstocks, the abundance and relative abundance of each chemical species in the washing machine may be varied to form custom washing solutions in the washing machine, e.g. based on the condition of the laundry and water quality. As an example, if the laundry is heavily soiled with proteins, greater amounts of alkali and enzymes may be used without a commensurate increase in other chemicals.

For example, non-ionic surfactants may be highly effective for removing soils. However, non-ionic surfactants may have considerably reduced effectiveness in hard water and/or at high temperatures. Supplying anionic surfactants and/or amphoteric surfactants may soften water and enhance cleaning effectiveness at high temperatures. Anionic surfactants may also be more environmentally friendly. Using custom solutions may allow variable dosing (type and quantity) to meet laundry needs. For example, using a combination of non-ionic and anionic surfactants may considerably reduce an amount of total surfactants needed to achieving cleaning targets. In particular, an amount of non-ionic surfactants needed may be significantly reduced. A reduction in "overfeeding" of chemicals may reduce costs and mitigate environmental impact.

For example, for hydrocarbon-contaminated textiles, it is found that effective emulsification of hydrocarbons may be achieved in a redox environment through higher purity surfactants and oxidizers specific to carbon chain and charge, e.g. stable water in oil (W/O) emulsions, specific to non-aqueous solvent purity and charge, are found. Cleaner textiles are achieved by enhancing the removal of hydrocarbons and preventing or mitigating potential subsequent redeposition. For example, it is found that a combination of charged surfactants in conjunction with mild alkaline and oxidizers may be used to mobilize and redox the non-aqueous solvents while emulsifying them by specifically charged surfactants for target constituent removal. High concentrates and supersaturated cleaning solutions may be formed that outperform standard industrial textile solutions and enhance a washing machine's cleaning action. For example, in some cases, advantages may be achieved using standard cleaning agents (or solvents) such as Glycol Ether EB (a typical ingredient to all surfactant solutions, as a stabilizer). Tighter control of pH, conductivity, ORP, and concentration of cleaning solutions vs. the BDAT standard displayed in the textile industry, may be achieved.

Chemicals herein may refer generally to substantially unitary or pure chemicals, which may be used to create (relatively dilute) chemical solutions for washing laundry. In some cases, chemicals may be solid or liquid. Various types of chemicals include surfactants, oxidizers or oxidant chemicals, alkalis, enzymes, and other chemicals.

Accordingly, in some aspects, there is disclosed an industrial laundry system that supplies chemicals to one or more washing machines for cleaning. Each chemical may be held as a solution in a dedicated tank fluidly connected to washing vessels of the one or more washing machines. The solutions may be selectively fed from the tanks to the washing vessels to form custom washing solutions therein.

It is found that preparing chemical solutions on-site using solid chemical feedstock may reduce costs, eliminate the relatively higher environmental impact of transporting and storing pre-made liquids, and facilitate variable concentration chemical solutions. It is further found that achieving better solutions may require properly wetting solid (granular) chemicals with respective solvents (such as water) to form solutions therein and/or for enabling chemical activation. Otherwise, for example, clumping of the granular chemical may occur, plugging of flow lines and components may occur, solutions may be poorly mixed or slow to mix, and granular chemicals may remain in an unwetted state unfavourable for achieving cleaning.

It is found that proper wetting of granular feedstock may be achieved by drawing chemical granules through a rotating fluid sheet prior to deposition in a tank of solution or a fluid conduit.

Accordingly, in some aspects, there is disclosed a wetting head for the industrial laundry system to receive water and the granular chemical to achieve wetting. Wetting may be achieved by breaking a fluid sheet of rotating solvent using the granular chemical. The fluid sheet is formed by drawing the solvent through a passage of the wetting head at least partially azimuthally around a central duct passing through the wetting head. The passage at least partially surrounds the central duct such that the fluid sheet at least partially occludes the central duct. The granular chemical then passes through the central duct by breaking the occluding fluid sheet to achieve wetting and mixing therewith.

It is found that using washing solutions comprising chemical solutions formed with solute in excess of what may be dissolvable in the solvent may be useful for achieving better cleaning and lower energy consumption. In particular, a saturated solution of a (pure) oxidant feedstock in water with excess solid (granular or particulate) oxidant feedstock mixed therein may be particularly advantageous for not only rendering substances colorless but also for removing soils from laundry and achieving higher quality cleaning with lower wash times, including oxidation of organics. In some cases, laundry may be cleaned using only such solutions and water without, or with low doses of, surfactants, or other chemicals. For example, environmental impact of resulting wastewater may be reduced, including by chemically degrading environmentally harmful soils in addition to removing such soils from laundry.

As referred to herein, a solution may comprise a solvent and a solute, including any portion of the solute that does not go into solution because the solution is saturated. Solutions may include supersaturated solutions. As referred to herein, saturated solutions may include supersaturated solutions.

It is found that such solutions may provide effective cleaning in soft water and, in some cases, also in hard water, e.g. water provided by municipal waterworks or other water which may be easily available. As such, in some cases, the use of builders and other additives for managing hard water may be greatly reduced (or eliminated). Cost savings and environmentally beneficial outcomes may follow. In comparison, 50% or more of pre-made laundry detergents, by weight, may comprise builders for managing hard water.

For example, laundry may be cleaned using only a solution of sodium percarbonate in water with the weight concentration (including dissolved and undissolved chemical) of sodium percarbonate at least twice, or up to five times a saturation concentration in water. Using only sodium percarbonate or other oxidants may be cost-effective and environmentally friendly. Without being bound by any particular theory of operation, it is conceived that cleaning by injecting saturated solutions having excess solute as solids into washing vessels holding laundry may enhance frictional or contact cleaning, improve chemical activity, enhance reactivity between chemicals and soils, and facilitate both (chemical and/or physical) degradation and removal of soils. In some cases, advantages may accrue even when a total concentration of chemicals in the washing vessel is below saturation.

Over time, if not agitated, excess solids in solutions may separate into distinct regions in the solution, e.g. they may settle or form clumps. As such, solutions with excess solute may not be available as pre-made detergents.

Accordingly, in some aspects, the industrial laundry system may be used to store or hold a solution of oxidant chemical in a (dedicated) tank fluidly connected to a washing vessel of a washing machine, wherein the solution has a weight concentration (including dissolved and undissolved chemical or solute) greater than the saturation concentration. The industrial laundry system may then selectively feed or supply the solution to the washing vessel to clean the laundry. The solution of oxidant chemical may be formed using solid chemical feedstock and water in the wetting head. For example, the wetting head may be disposed above the tank. In some aspects, an agitator may be disposed in the tank to fully mix the solution and/or maintain the solution in a fully-mixed state. In some aspects, other than the oxidant chemical, the solution may be substantially free of surfactants, builders, alkalis, and other oxidants.

In some aspects disclosed herein, sensors may be used to track laundry as it moves through a wash cycle in the washing machine. The sensors may facilitate obtaining proof of delivery of chemical solutions and proof of cleaning (e.g. including sanitization). In some cases, quality assurance may be performed more efficiently (in terms of costs and time) and with high frequency, e.g. continuously in time. For example, in some embodiments, real-time or immediate proof of cleaning (certification) may be facilitated. In some embodiments, a need for costly and time-consuming certification processes may be avoided. For example, real-time or immediate proof of cleaning via sensors as describe herein may obviate a need for specialized testing (such as by using an external lab) of randomly sample textiles once per week or month. In many cases, such random sampling may not be sufficient to reveal failures in cleaning processes.

In some aspects, there is described a method of cleaning laundry in a washing vessel, comprising: supplying a first solvent to the washing vessel; forming a saturated solution of an oxidant chemical in a second solvent, at least some of the oxidant chemical being undissolved in the second solvent; and injecting the saturated solution into the washing vessel to cause cleaning of the laundry by undissolved oxidant chemical. In various embodiments, injecting the saturated solution into the washing vessel includes injecting the saturated solution into the washing vessel during a first wash stage of the laundry. In various embodiments, a weight of the undissolved oxidant chemical in the saturated solution is greater than a weight of dissolved oxidant chemical in the saturated solution. In various embodiments, the saturated solution is a supersaturated solution. In various embodiments, the oxidant chemical is granular, and the saturated solution is substantially free of builders and surfactants. In various embodiments, the method further comprises: forming an ionic surfactant solution separate from the saturated solution, the ionic surfactant solution including an ionic surfactant; forming a non-ionic surfactant solution separate from the saturated solution, the non-ionic surfactant solution including a non-ionic surfactant; and injecting the ionic surfactant solution and the non-ionic surfactant solution into the washing vessel. In various embodiments, injecting the saturated solution into the washing vessel includes mixing the saturated solution with a third solvent to form a mixed solution; and conveying the mixed solution to the washing vessel.

In some aspects, there is described a system for cleaning laundry, comprising: a tank configured to receive water and oxidant chemical to form an oxidant solution; and a washing vessel for holding laundry and fluidly connected to the tank and a water source, the washing vessel configured to receive the oxidant solution from the tank and water from the water source to clean the laundry. In various embodiments, the system further comprises an agitator disposed inside the tank for mixing the water and the oxidant chemical to form the oxidant solution. In various embodiments, the tank is configured to receive the water and the oxidant chemical to form the oxidant solution as a saturated solution containing granules of the oxidant chemical. In various embodiments, wherein the saturated solution is substantially free of surfactants. In various embodiments, wherein the tank is a first tank, the system further comprising: a second tank configured to receive water and surfactant to form a surfactant solution to supply to the washing vessel. In various embodiments, the system further comprises a valve configured to control supply of the oxidant solution to the washing vessel.

In some aspects, there is described a wetting head for mixing a chemical with water, the wetting head comprising: a central duct; a passage at least partially circumferentially surrounding the central duct and in fluid communication with the central duct; a first inlet supplying water to the central duct via the passage, the passage configured to form a sheet of water at least partially occluding the central duct; and a second inlet configured to supply a granular flow of the chemical through the sheet of water to form a granular flow of wetted chemical into the central duct. In various embodiments, the first inlet is configured to impart rotation to the water flowing into the central duct around the central duct to mix the chemical and the water.

In some aspects, there is described a method of operating a washing machine having a washing vessel, comprising: mixing oxidant chemical and water in a tank to form a saturated solution containing granules of oxidant chemical; supplying water to the washing vessel; and injecting the saturated solution from the tank into the washing vessel.

In some aspects, there is described a system for delivering washing solutions to a washing machine having a washing vessel holding laundry for cleaning, the system comprising: a first tank holding a first solution and configured to fluidly connect to the washing vessel to supply the first solution to the washing vessel, the first solution including an oxidant chemical and being substantially free of surfactants; a second tank holding a second solution and configured to fluidly connect to the washing vessel to supply the second solution to the washing vessel, the second solution including a surfactant and being substantially free of oxidant chemicals; one or more fluid devices configured to selectively control flow of the first solution from the first tank to the washing vessel and the second solution from the second tank to the washing vessel; one or more processors; and machine-readable memory having instructions stored thereon that, when executed by the one or more processors, cause the one or more processors to: receive a signal indicative of a soil condition of the laundry; and control the one or more fluid devices to supply the first solution and the second solution to the washing vessel based on the soil condition (e.g. through a high flow water conduit). In various embodiments, the first solution is a saturated solution containing granules of oxidant chemical.

In some aspects, there is described a method of cleaning laundry in a washing vessel, comprising: supplying a solvent to the washing vessel; forming a mixed surfactant solution, the mixed surfactant solution including a non-ionic surfactant and an ionic surfactant; and injecting the mixed surfactant solution into the washing vessel. In various embodiments, an amount of the ionic surfactant is based on a washing temperature in the washing vessel. In various embodiments, the solvent is water and an amount of the ionic surfactant is based on hardness of the water. In various embodiments, the ionic surfactant is an anionic surfactant.

In an aspect, the disclosure describes a system for cleaning laundry. The system also includes a container, the container capable of holding a chemical that is granular and suitable for cleaning laundry; a tank that receives the chemical from the container and receives a solvent to form a solution of the chemical in the solvent, the solution including undissolved chemical; and a washing vessel for holding laundry and fluidly connected to the tank and a water source, the washing vessel suitable for receiving the solution with the undissolved chemical from the tank and water from the water source to clean the laundry.

In an aspect, the disclosure describes a method of cleaning laundry in a washing vessel. The method of cleaning laundry also includes supplying a first solvent to the washing vessel; mixing oxidant chemical and a second solvent in a tank to form a saturated solution, at least some of the oxidant chemical being undissolved in the saturated solution; and injecting the saturated solution from the tank into the washing vessel to cause cleaning laundry by undissolved oxidant chemical. Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

Figure 1:
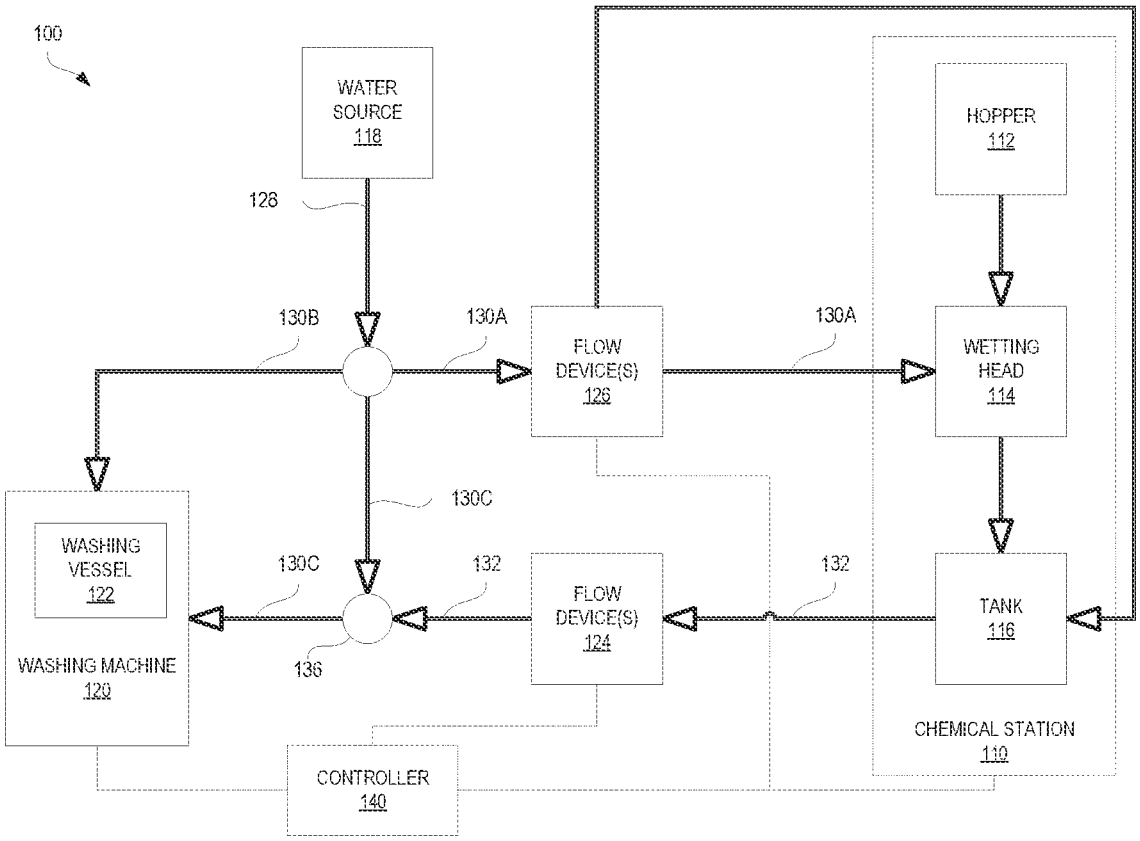
FIG. 1 is a schematic flow diagram of an industrial laundry system, in accordance with an embodiment.

The following disclosure relates to industry laundry systems. In some embodiments, the devices, assemblies and methods disclosed herein can facilitate faster washing of laundry, lower levels of soiling in washed laundry, and lower environmental impact compared to existing washing machines (washing systems).

It is found that using chemical feedstocks (and solutions thereof) directly in washing machines may yield lower wash times, higher quality cleaning (lower soil levels on cleaned laundry), lower water usage, and lower wastage, as compared to pre-made laundry detergent formulations.

It is found that preparing chemical solutions for washing machines on-demand and using chemical feedstocks may be particularly advantageous. It is found that using washing solutions comprising chemical solutions formed with solute in excess of what may be dissolvable in the solvent may be useful for achieving better cleaning and lower energy consumption. In particular, oxidant chemicals are found to be particularly advantageous. For example, in some cases, an oxidant solution may be used to clean laundry without any additional solutions.

In some embodiments, this may be achieved using an industrial laundry system that prepares and supplies chemical solutions to one or more washing machines for cleaning using a wetting head that achieves wetting by breaking a fluid sheet of rotating solvent using the granular chemical. In various embodiments, the industrial laundry system may be used to store or hold a solution of oxidant chemical in a dedicated tank fluidly to be delivered to the washing machine(s). The solution has a weight concentration (including dissolved and undissolved chemical or solute) greater than the saturation concentration. In some aspects, an agitator may be disposed in the tank to fully mix the solution and/or maintain the solution in a fully-mixed state. In some aspects, other than the oxidant chemical, the solution may be substantially free of surfactants, builders, alkalis, and other oxidants.

Example test results using a bar mop test are shown in Table 1, based on Textile Rental Services Association (TRSA) standards. Dirty bar maps are cleaned using an example embodiment and an example baseline system. Dirty bar maps may be collected in bulk bags from various locations, including restaurants and offices, and be mixed together thereafter. Similar advantages may be demonstrated for bar and shop aprons, butcher coats, uniforms, napkins, linen, print towels, and roll towels (e.g. all showing between 32-38 minute wash times).

Industry and government set standards for microbial activity on clean textiles by type and application. This may be measured in terms of colony-forming units (cfu) per unit area. In various embodiments, it is found that the total aerobic microbial count (TAMC) may be 2.65 cfu/dm$^2$ bar mops and 1.77 cfu/dm$^2$ on napkins. In various embodiments, it is found that the total aerobic yeast and mold count (TYMC) may be 1.33 cfu/dm$^2$ bar mops and 0.44 cfu/dm$^2$ on napkins. For example, cleaned textiles here may satisfactorily exceed TRSA standards, which have require less than 20 cfu/dm$^2$ for TAMC and TYMC.

TABLE 1

| Item | Example embodiment | Example baseline system | Difference |
|---|---|---|---|
| Wash Time (actual washer run time) | 38 min | 80 min | 53% |
| Water (municipal or well) | 1,320 | 2,354 | 44% |
| Cost per 100 lbs of textile | $3.51 | $4.69 | 25% |
| Hexane Extractable Material (HEM) | 249 | 658 | 62% |
| Total Suspended Solids (TSS) | 1,300 | 2,300 | 43% |
| Biochemical Oxygen Demand (BOD) | 4,200 | 9,500 | 55% |
| Chemical Oxygen Demand (COD) | 8,400 | 18,000 | 53% |
| Conductivity us/cm | 3,240 | 4,670 | 31% |
| Total Dissolved Solids | 2,048 | 2,988 | 31% |
| Sodium | 640 | 680 | 3% |
| Sodium Volume (adjusted)* | 358 | 680 | 47% |

*adjusted sodium on bar mops based on water usage; keeping water volume constant As another example of cleaning hydrocarbons, Table 2 shows results from wet towels after washing and extraction before entering a dryer. "Solvent-level" may refer to a level of BTX solvents in the laundry.

TABLE 2

| | Example baseline | Example embodiment | Reduction |
|---|---|---|---|
| High solvent-level | | | |
| VOC | 763 ppm | 664 ppm | 99 or 13% |
| BTX | 9,245 ppm | 3,439 ppm | 5,806 or 63% |
| Medium solvent-level | | | |
| VOC | 999 ppm | 295 ppm | 704 or 70% |
| BTX | 1,339 ppm | 368 ppm | 971 or 73% |
| Low solvent-level | | | |
| VOC | 316 ppm | 296 ppm | 20 or 6% |
| BTX | 1,600 ppm | 1,315 ppm | 285 or 18% |

A reduction in VOCs (Volatile Organic Compounds) and flammable and/or non-aqueous solvents like BTX (Benzene, Toulene, and Xylene) is achieved. The reduction in the VOCs may be achieved by washing the textiles in oxidizers such as percarbonate at the pH of 10-11.2 in conjunction with other chemicals described herein. The dryer may remove substantially all of the BTX, and so removing BTX from the textiles in the washer allows reduction of dryer emissions (by a similar percentage to that noted above with respect to the wet towels).

Aspects of various embodiments are now described in relation to the figures.

FIG. 1 is a schematic flow diagram of an industrial laundry system 100, in accordance with an embodiment.

Material paths are indicated with hollow-bodied arrows.

A chemical station 110 may prepare and hold a chemical solution (a chemical in solution with a solvent). The chemical solution may be prepared using chemical feedstock, or chemical. One or more chemical solutions may be used as washing solutions suitable for cleaning laundry. Advantageously, the chemical station 110 may be configured to make solutions in any or in a large variety of concentrations that leads to flowable solutions, including concentrations where chemicals are not fully dissolved in the solvent or water.

A container 112 of the chemical station 110 holds the chemical. In various embodiments, the container 112 may be a hopper or a bag. The hopper may have a funneled end with an opening to draw the chemical out of the hopper. In various embodiments, the chemical is substantially solid and configured to form a solution with a solvent. The chemical may be in granular form. In some cases, the chemical may be a dry powder product, and may be a high (%) concentration active product.

In various embodiments, the chemical may be substantially free of one or more of an oxidant, a surfactant, an alkali, an enzyme, or other type of chemical. In some embodiments, the chemical may be an oxidant chemical. Examples of oxidants include sodium percarbonate, potassium percarbonate, hydrogen peroxide, sodium hypochlorite, calcium hypochlorite, peroxyacetic acid, ozone, chlorine, sodium perborate, ammonium persulfate, potassium persulfate and sodium persulfate.

A tank 116 may be configured to receive the chemical from the container 112 and a solvent, such as water or other solvent, to form a solution of the chemical in the solvent such that the solution includes at least some undissolved chemical that provides a cleaning effect.

A wetting head 114 of the chemical station 110 may receive the chemical from the container 112 for wetting the chemical. The wetting head 114 combines the chemical with a solvent and supplies it to the tank 116 of the chemical station 110.

The wetting head may receive water from a water source 118. In various embodiments, the water source 118 may be a municipal water source or a water tank with water stored therein. For example, soft water, distilled water, or relatively hard water may be used. In some cases, municipal water may be hard water. In some embodiments, hard water may include water with a hardness measurement in the range 60-180 mg/L (or ppm).

In some embodiments, the wetting head 114 may generate a chemical solution for feeding to the tank 116. The tank 116 may thereby accumulate a chemical solution in the tank 116.

In some embodiments, the wetting head 114 may wet, hydrate, and/or chemically activate the chemical or chemical granules, in preparation for going into solution. In some embodiments, the chemical may go into solution in the tank 116. In various embodiments, the tank may be supplied water from the water source 118. For example, water supplied to the tank 116 may help the chemical go into solution therein.

The chemical station 110 may be connected to a washing machine 120. In particular, the tank 116 may be fluidly connected to a washing vessel 122 of the washing machine 120.

The washing machine 120 may be configured to automatically wash laundry using mechanical and chemical action, e.g. using agitation, washing solutions and water. For example, the washing machine 120 may remove soils from the laundry in one or more main stages of operation, which may include agitation, rinse, and spin stages. The washing machine 120 may have one or more post-wash stages of operation. In some embodiments, the post-wash stages may be remedial stages to treat soils not adequately handled, either by removal or discoloration, during the main stages of operation. The washing machine 120 may have one or more pre-wash or pre-rinse stages of operation before a washing or suds step. The pre-wash stages may prepare soils for treatment without the use of chemistry, e.g. a flush of hot water to dislodge soils on heavy soils. After the pre-wash stage(s), the washing machine 120 may subject the laundry to one or more wash stages (or breaks), wherein the soils are treated, e.g. by removal, discoloration, or otherwise. Wash stages may use chemicals. In some cases, each wash stage may be configured to treat one or more soil(s), e.g. each wash stage may be adapted for a specific soil. In some cases, a wash stage may involve preparing soils for treatment in a subsequent stage. In some cases, the washing machine 120 may use only a single wash stage (first wash stage) or two or more wash stages (first wash stage, second wash stage, and so on).

It was found, by monitoring washer vents during cleaning of hydrocarbon-contaminated towels, that a very high flash off of VOCs and BTX may be released. Reduction of harmful emissions to the environment may be achieved by adding a specific step to the pre-wash stage. The step may include acidifying the load, e.g. with an acid such as citric acid 30% solution at between 4,000 to 10,000 ppm, and then adding at least one of sodium bentonite at about 10,000 to 60,000 ppm or activated carbon at similar doses. It was found that adding sodium bentonite and citric acid during a 5-minute pre-wash stage led to a peak washer load (of emissions) of 32,743 ppm of BTX and for the rest of the 5 minute stage, the washer load settled down to >20,183 ppm of BTX. In contrast, washer load without sodium bentonite (and acidification) peaked at >50,000 ppm of BTX, then stayed at >50,000 ppm of BTX for most of the 5 minute stage, showing an advantage (reduction in emissions) of about 35%. In some embodiments, an activated carbon may be used instead of sodium bentonite.

The washing vessel 122 may hold laundry and washing fluids together for intermingling during washing. In some embodiments, the washing vessel 122 may include a drum for holding clothes. In some embodiments, the washing vessel 122 may be a tub. In some embodiments, the washing vessel 122 may be an outer tub and the drum may be an inner tub. In some embodiments, the washing machine 120 may be a tunnel washer and the washing vessel 122 may be a part of the tunnel washer, e.g. the washing vessel 122 may be a section of the tunnel washer or may be arranged in an elongated series of sections along the tunnel washer.

The washing machine 120 (e.g. the washing vessel 122) may be fluidly connected to the water source 118 for receiving water therefrom for washing. The washing vessel 122 may be configured to receive water from the water source 118. In various embodiments, water supplied to the washing machine 120 may be controlled via one or more valves and/or pumps. In some cases, the washing machine 120 may include a valve assembly for controllably discharging water into the washing vessel 122. In various embodiments, the washing machine 120 may have separate heating elements that may facilitate achieving proper cleaning temperature, e.g. heating elements may allow live steam injection.

One or more flow device(s) 124 may control or actuate (e.g. by pumping) fluid flow of chemical solution from the tank 116 to the washing vessel 122. The washing vessel 122 may receive the solution with the undissolved chemical from the tank 116 and water from the water source 118 to clean the laundry. For example, in some embodiments, the one or more flow device(s) 124 may include a valve configured to control supply of oxidant solution to the washing vessel.

The chemical solution from the chemical station 110 may be supplied to the washing machine 120 in one or more stages of washing. The washing vessel 122 may be fluidly connected to the water source 118. In some embodiments, a solution of chemical (e.g. oxidant chemical) in solvent (e.g. water) may be supplied to the washing vessel 122 during a first (and/or only) wash stage, a wash stage preceding another wash stage, or as a main stage of operation of the washing machine 120. For example, wash stage may refer to wash stages wherein chemicals are supplied to the washing vessel 122. Oxidant chemical solutions may not be provided, or provided in addition to, in a post-wash stage of operation of the washing machine 120.

One or more flow device(s) 126 may control or actuate (e.g. by pumping) water flow from the water source 118 to the wetting head 114 and/or the tank 116. In some embodiments, the one or more flow device(s) 126 may selectively control supplying water to the wetting head 114 and/or the tank 116.

In various embodiments, the one or more flow device(s) 124,126 may include valves, pumps, and or other devices for providing motive force to fluids and/or controlling flow of fluids, e.g. by blocking or releasing fluid.

In some embodiments, the water source 118 may be configured to supply flow via a main flow line 128. The main flow line 128 may split into three separate flow lines. A first flow line 130A may be fluidly connected to the chemical station 110. A second flow line 130B may be directly fluidly connected to the washing machine 120, e.g. to the washing vessel 122. A third flow line 130C may form a junction 136 with a flow line 132 from the chemical station 110 carrying the chemical solution and may be configured to receive water (solvent) from the water source 118 (or solvent source) between the tank 116 and the washing vessel 122.

In some embodiments, the main flow line 128 may be a pipe having a circular cross-section with a substantially 3 inch diameter or, in some cases, anywhere between 1 inch and 6 inches. In some embodiments, main flow line 128 may comprise a plurality of pipes, e.g. each pipe may deliver a certain type of water, including cold or hot water, temperature water, and/or recycled or reuse water. In some embodiments, chemical solutions may be injected directly into the main flow 128 without an intermediate tank.

In some embodiments, each of the first flow line 130A and second flow line 130B may comprise a pipe defining a circular flow cross-section having a substantially 1 inch diameter or, in some cases, anywhere between 0.5 inches and 4 inches.

The third flow line 130C may provide conveyance to the chemical solution towards the washing vessel 122 (or the washing machine 120), e.g. by flushing. In some embodiments, supplying the chemical solution via the third flow line 130C may reduce pumping requirements, and associated fixed and operational costs.

In some embodiments, the chemical solution and the water may at least partially mix in the junction 136 to form a relatively more dilute chemical solution or mixed solution. The mixed solution is then conveyed to the washing vessel 122 via a remaining portion of the third flow line 130C (downstream of the junction 136) leading towards the washing machine 120. In some embodiments, the junction 136 may be configured to limit mixing of the chemical solution in water. For example, the flow into the washing machine 120 from the third flow line 130C may comprise a heterogeneous fluid having a substantially water phase or portion, a substantially chemical solution phase or portion, and a dilute chemical solution phase or portion.

In some embodiments, a controller 140 may be operably connected to the one or more flow device(s) 124, 126, the washing machine 120, and/or the chemical station 110.

A solute compatible with (or soluble in) a solvent will generally dissolve over time therein to form a solution. The solute and solvent then interact on a molecular level in a solvation process (or hydration, in the case of water), wherein a molecule of the solute, or a part thereof, is surrounded by the solvent. Ionic compounds may partially or fully disassociate upon dissolution. A solution may be more amenable for cleaning than either the solute or the solvent alone because of the change in chemistry.

As a concentration of solute in a solvent is increased, a saturation concentration is reached. The solute may dissolve in the solvent up to the saturation concentration, given sufficient time and appropriate mixing conditions. However, dissolution may take longer as the saturation concentration is reached. Below the saturation concentration, a solute may at least temporarily coexist with a solvent without going into solution. In some cases, a solute may be partially solvated or hydrated. The saturation concentration may depend on a variety of factors, including temperature.

Solute added to the solvent may no longer dissolve therein if the solute concentration in the solvent is at or exceeds the saturation concentration. In some cases, changing a temperature of a solution may result in a supersaturated solution, wherein dissolved content concentration may be greater than the saturation concentration. Supersaturated solutions are unstable or metastable and may be prone to precipitate solids to return to dissolved content concentrations at or below the saturation concentration (saturated or undersaturated solutions, respectively), with the excess solute remaining as a separate phase.

Solid particles or granules in saturated solutions may settle or form clumps if not treated. For example, such solutions may be continually mixed or agitated to maintain a fully mixed solution.

In some embodiments, the industrial laundry system 100 may be configured to form a saturated solution of a chemical in water to use in the washing machine 120 for cleaning laundry.

The chemical may be an oxidant chemical. In various embodiments, the oxidant chemical may be granular, particulate, or powdered. In some embodiments, the saturated solution may contain primarily or only solvent (e.g. water) and oxidant chemical. For example, the saturated solution may be substantially free of builders and surfactants. In some cases, the saturated solution may contain trace impurities and/or additives.

The saturated solution may be injected into the washing vessel 122 for cleaning laundry. In various embodiments, the saturated solution may be used during a first wash stage of the laundry (or first wash stage of the washing machine 120) or main wash of the laundry (or main wash of the washing machine 120).

The amount of chemicals in the washing vessel 122 relative to water may be sufficiently low to drop the chemical concentration in the washing vessel 122, as a whole, below saturation. However, the chemical solution may exist heterogeneously in the washing vessel 122 for a period of time due to finite mixing times and time for equilibration. In some embodiments, saturated chemical solutions and undissolved chemicals may interact directly with laundry, e.g. granules may rub against clothes and/or may lodged therein.

At least some of the chemical may be configured to be undissolved in the solvent. For example, some of the chemical may remain undissolved in the water in tank 116 and delivered as such to the washing machine 120. In some cases, the saturated solution may be prepared as a supersaturated solution and may be delivered as such to the washing machine 120. Solid particles of the chemical may precipitate in the supersaturated solution so that the washing vessel 122 may use chemical solutions with solid precipitates of the chemical. The saturated solution may include granules of oxidant chemical and/or may be substantially free of surfactants.

In various embodiments, saturated solutions may be prepared "on-demand" so that solid particles remain mixed and dispersed throughout the saturated solution. In some embodiments, agitators in the tank 116 may facilitate keeping solutions mixed (or fully-mixed), i.e. the solvent and chemical mixed together to avoid clumping (in case of undissolved solids) or to avoid chemicals precipitating in a supersaturated solution.

In various embodiments, on-site preparation of chemical solutions may lead to more active fresh chemistry forms at higher concentrations, which may require shorter pumping and conveyance times coupled with better chemical performance.

In various embodiments, introducing a saturated solution with non-dis solved particles into the washing machine 120 may enhance the mechanical action of the chemical solution in the washing machine 120 by introducing a highly active chemical in a wetted granular hybrid form, allowing for more contact with textiles, both due to increased mechanical interaction associated with granules as well as the higher concentration of chemical in the washing solution. The result may be lower chemical usage and a reduction in wash times.

In some embodiments, a weight of undissolved chemical (e.g. undissolved oxidant chemical) in the saturated solution may be greater than a weight of dissolved chemical (e.g. dissolved oxidant chemical) in the saturated solution or twice the weight of dissolved chemical in the saturated solution. For example, sodium percarbonate may be mixed with water to form a solution with 30% sodium percarbonate or between or between 15-30% sodium percarbonate (by weight). In some embodiments, greater than 15% of the sodium percarbonate may be undissolved, e.g. in the form of particulates suspended in the water. In various embodiments, surfactants, builders, and bleaching agents may be delivered.

As will be discussed later, the industrial laundry system 100 may include additional chemical stations. Additional chemical stations may be used to provide additional capacity or other chemical solutions.

For example, in some embodiments, the industrial laundry system 100 may be configured to form a surfactant solution in a separate chemical station. The surfactant solution may be injected into the washing vessel 122, e.g. together with the saturated solution of oxidant chemical.

In various embodiments, the industrial laundry system 100 may form, e.g. in separate chemical stations, a non-ionic surfactant solution, an anionic surfactant solution, a cationic surfactant solution, and/or an amphoteric surfactant solution. Non-ionic surfactant may be less effective at high-temperatures and/or in hard water. Ionic surfactants (e.g. anionic surfactants) may reduce hardness, e.g. by binding to free ions, and may be more effective at high-temperatures. In some cases of non-aqueous solvent removal (e.g. BTX solvent removal), cationic surfactants may be advantageous in late washing stage(s), particularly when combined with souring by using of citric acid in an early wash stage(s) prior to the final rinses.

In various embodiments, supply of ionic surfactants may be varied to achieve desired cleaning efficiency and performance. In some embodiments, the ionic surfactant is an anionic surfactant. In various embodiments, an amount of ionic surfactant injected into the washing vessel 122 may be based on a washing temperature therein and/or based on hardness of water used to clean laundry in the washing vessel 122. For example, the amount of ionic surfactant may be increased for high-temperature and/or hard water washing cycles. In various embodiments, non-ionic surfactant solution(s) and ionic surfactant solution(s) may be mixed to form a mixed surfactant solution, which may then be injected or supplied to the washing vessel 122. In various embodiments, the washing temperature may refer to a temperature of washing fluids in the washing vessel 122 during cleaning of laundry, or temperatures the laundry is exposed to during soil loosening and/or removal.

In some embodiments, chemical station(s) 110 may directly form a mixed surfactant solution including a non-ionic surfactant and an ionic surfactant, e.g. by supply a mixture of dry ionic and non-ionic surfactant powders, by sequential supply of ionic and non-ionic surfactant powders, or by simultaneously (but separately) supplying the ionic and non-ionic surfactant powders to one or more wetting heads 114.

In various embodiments, using opposing charge chemistry (chemicals and solutions thereof) may facilitate stabilizing emulsions and enhancing rates of soil removal at reduced dosages and reaction times. For example, contaminates in the wastewater may be lowered, as a result, and higher dosage requirements leading to overfeeding of certain chemicals may be overcome. Without some advantages described herein, overfeeding of chemical solutions may be needed to force chemical reactions to achieve emulsions of soil in the solvents, e.g. by suspending, sequestering, and/or saponifying of soils in the solvent.

For example, in some cases, a small amount of ionic surfactant (anionic) added to the washing solution may greatly increase effectiveness of the non-ionic surfactant solution. In some embodiments, only ionic surfactants may be supplied. In some cases, ionic surfactants may have lower environmental impact.

In various embodiments, industrial laundry system 100 may allow raw materials to be utilized above their known solubility limit, including in combination, to reduce usage of chemicals and washing solutions and achieve a more efficient process. Savings in time and energy, and reduction in mechanical wear, may be achieved while facilitating cleaner and more sanitary textiles.

Figure 2A:
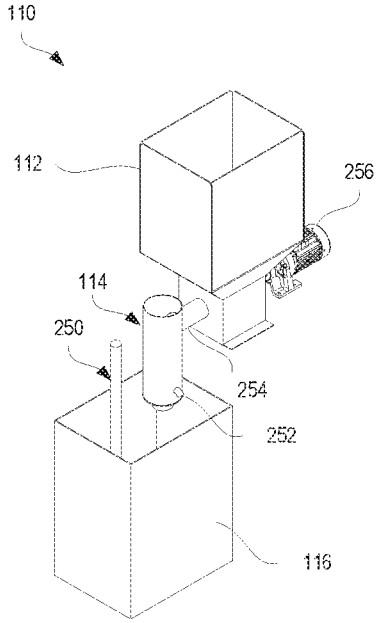
FIG. 2A is a perspective view of a chemical station, in accordance with an embodiment.

FIG. 2A is a perspective view of a chemical station 110, in accordance with an embodiment.

Figure 2B:
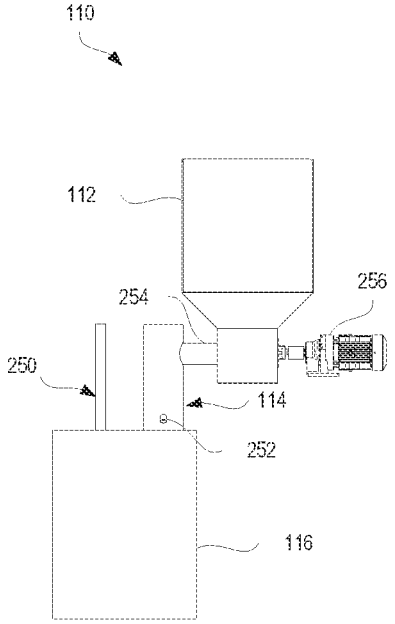
FIG. 2B is a side elevation view of the chemical station.

FIG. 2B is a side elevation view of the chemical station 110, in accordance with an embodiment.

Figure 2C:
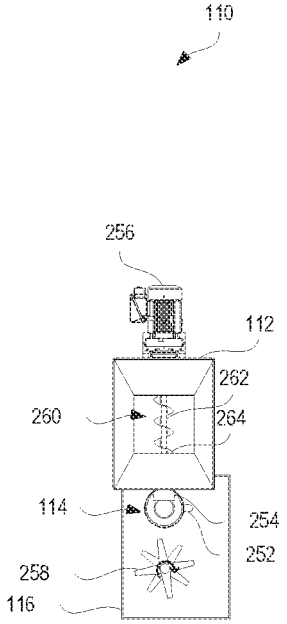
FIG. 2C is a top plan view of the chemical station.

FIG. 2C is a top plan view of the chemical station 110, in accordance with an embodiment.

The chemical station 110 may be part of a system for cleaning laundry.

The container 112 may be disposed vertically above the tank 116. Granular chemicals may at least partially or fully fill the container 112 to be pushed through to the tank 116, at least partially by gravity. In various embodiments, desiccant may keep the chemicals in the container 112 dry.

As mentioned earlier, the tank 116 may be configured to receive water and oxidant chemical to form an oxidant solution in the tank 116. The washing vessel 122 may be fluidly connected to the tank 116.

The wetting head 114 may be coupled to the container 112. The wetting head 114 may be disposed vertically between the container 112 and the tank 116 to wet chemicals received from the container 112 and convey them to the tank 116. A duct 254 may provide a connection between the container 112 and the wetting head 114 to convey chemicals from the container 112 to the wetting head 114. The duct 254 may define an chemical inlet 255 opening into the central duct 376 for receiving chemicals from the container 112 to draw these into the wetting head 114. The wetting head 114 may comprise an inlet 252 for receiving water into the wetting head 114 for wetting the chemical.

An auger 260 (or screw conveyer) may be coupled to or with the duct 254. A motor 256 (e.g. an electric motor) may be operably coupled to a shaft 262 of the auger 260. Blades 264 of the shaft 262 may be configured to draw chemical out from the container 112 and into the tank 116 via the duct 254.

An agitator 250 (or mixer) may be disposed inside the tank 116. The agitator 250 may be configured to mix water and oxidant chemical to form oxidant solution for cleaning laundry. The agitator 250 may continue to homogenize the chemical solution and finish wet out (or complete wetting) of chemical granules. The agitator may comprise a shaft coupled to agitator blades 258 distributed circumferentially around the shaft and along the length of the shaft. The agitator blades 258 may rotate to maintain the chemical solution fully mixed. In various embodiments, the agitator 250 may be driven by a variable motor to allow for customizable mixing energy to ensure chemical solutions are appropriately mixed and any undissolved chemicals are appropriately dispersed.

In some cases, the wetting head 114 may reduce or eliminate a need for mixing in the tank 116 as the chemical may be wetted out in a fashion that allows it to become a very active chemical prior to entering the tank 116. This action may allow for faster maturity of the chemistry of the chemical as it is introduced into the tank 116.

In some embodiments, another tank (and chemical station) may be configured to receive water and surfactant to form a surfactant solution to supply to the washing vessel.

In some embodiments, additional components not shown in FIGS. 2A-2C may be used to provide structural integrity.

Figure 3A:
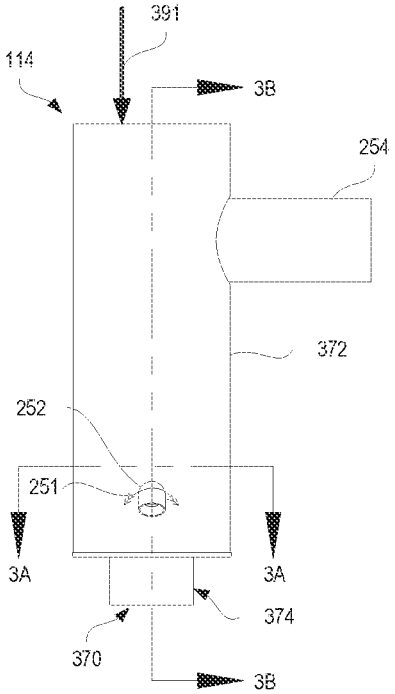
FIG. 3A is a side elevation view of a wetting head, in accordance with an embodiment.

FIG. 3A is a side elevation view of a wetting head 114, in accordance with an embodiment.

Figure 3B:
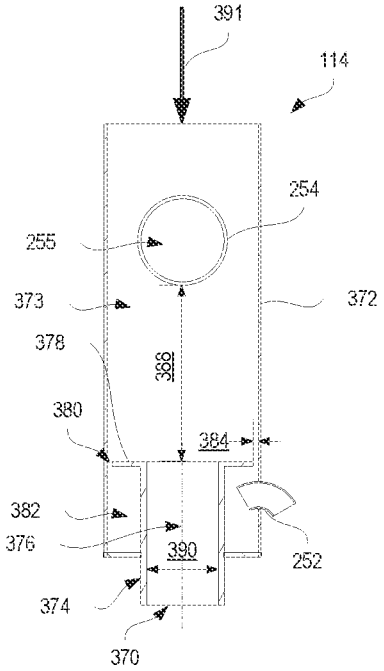
FIG. 3B is a cross-sectional view of the wetting head, along the line 3B-3B in FIG. 3A.

FIG. 3B is a cross-sectional view of the wetting head 114, along the line 3B-3B in FIG. 3A.

Figure 3C:
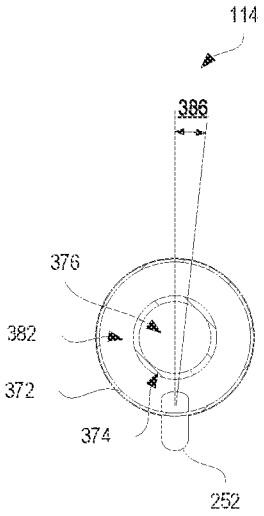
FIG. 3C is a cross-sectional view of the wetting head, along the line 3C-3C in FIG. 3A.

FIG. 3C is a cross-sectional view of the wetting head 114, along the line 3C-3C in FIG. 3A.

The wetting head 114 may wet a chemical and facilitate mixing the chemical with water. The wetting head 114 may receive the chemical via the duct 254 and release intermingled water and chemical via an outlet 370.

The wetting head may comprise a body 372 connected to the duct 254. The duct 254 may be in flow communication with an upper portion 373 of the body 372 to allow granular flow of chemicals therethrough. Granular chemical flow may be received in the body 372 via the duct 254. The body 372 may define a substantially closed spaced with ingress via the duct 254 and the inlet 252 for water, and egress via the outlet 370.

A pipe 374 may be disposed at least partially inside the body 372. The pipe 374 may be substantially concentric with the body 372 (e.g. arranged around a common axis shown in FIG. 3B). The pipe 374 may define a central duct 376 for receiving chemicals and water therein. The pipe 374 may pass through the wetting head 114 to form the outlet 370 fluidly connected to the central duct 376. The pipe 374 may be at least partially vertical such that the central duct 376 is at least partially vertical.

An end of the pipe 374 proximal to the duct 254 may have a flange 378. The upper portion 373 may be defined as the portion of the wetting head 114 above the pipe 374 and/or the pipe 374, and/or connected to the duct 254.

The flange 378 may define a slit 380 (or a passage) between the pipe 374 and the body 372. The slit 380 may open at least partially vertically upward to cause fluid passing therethrough in an upward direction to thereafter fall downwards due to gravity. The slit 380 may be at least partially circumferentially surrounding the central duct 376 and in fluid communication therewith. In some cases, the pipe 374 may be coupled to a plate to form a restriction defining the slit 380. For example, the slit 380 may be an annulus formed between the pipe 374 and the plate (or an outer portion of the flange 378).

The pipe 374 may couple with or fit into the body 372 to form a substantially annular cavity 382 at an end of the body 372 relatively distal from the duct 254. An inner wall of the cavity 382 may be defined by the pipe 374. An outer wall of the cavity 382 may be defined by the body 372.

The cavity 382 may define a substantially closed spaced with ingress via the inlet 252 for water, and egress via the slit 380. The slit 380 may fluidly connect the cavity 382 to the upper portion 373. In some embodiments, the wetting head 114 may comprise additional one or more passages similar to slit 380, and which may be referred to collectively as the slit 380.

Fluid (solvent or water) may be supplied to the cavity 382 via the inlet 252, in a continuous manner. The fluid may at least partially fill the cavity 382 to be drawn out therefrom (e.g. by overflowing) through the slit 380 out into the upper portion 373 of the body 372 to form a sheet of fluid. The fluid may flow therefrom out of the outlet 370 via the central duct 376. Once the cavity 382 is filled, a substantially continuous flow through the inlet 252 may allow a substantially continuous flow through the slit 380. In some embodiments, the cavity 382 may not be filed or overfilled completely when there is flow through the slit 380. For example, a rotational or cyclonic flow may form in the cavity 382 around the central duct 376. The rotational or cyclonic flow may be confined to a layer close to a wall of the cavity 382 and may overflow through the slit 380 into the upper portion 373 of the body 372 without fully filling the cavity 382.

In various embodiments, the slit 380 may be configured to achieve desired flow behaviour from the cavity 382 to the upper portion 373. For example, reducing a width 384 of the slit 380 may increase flow velocity and, where the flow remains substantially contiguous (or non-separated) through the slit 380, may provide passage of greater surface area of fluid per unit time through the slit 380.

In some embodiments, the slit 380 may have a substantially uniform width of 0.25 inches and may be configured to allow flow therethrough at a flow rate between 5 and 30 gallons per minute (GPM), e.g. substantially at 15 GPM. In some embodiments, the ratio of the width of the slit 380 (in inches) and flow rate (in GPM) of flow therethrough may be between 100:1 and 50:1, e.g. 100:1.6. In various embodiments, the width of the slit 380 may be between 0.08 inches and 2 inches. For example, in various embodiments, the slit 380 may be configured to allow flow rates in ranges falling between 5 and 125 GPM.

The inlet 252 may be configured to inject fluid into the cavity 382 to achieve desired behaviour of flow through the slit 380. For example, the inlet 252 may be positioned based on a desired flow behaviour. The inlet 252 may injected fluid pointed away from the slit 380 to prevent direct flow of fluid from the inlet 252 to the slit 380, e.g. bypassing filling the cavity 382, and to facilitate flow through the slit 380 by overfilling of the cavity 382. In some cases, the inlet 252 may be configured to inject the flow proximal to a wall of the cavity 382 to facilitate impingement of fluid thereon, and/or provide velocity reduction. In some embodiments, flow in the cavity 382 may remain substantially laminar. For example, providing flow through the slit 380 by overfilling or swelling instead of direct injection may reduce fluid turbulent fluctuations.

In some embodiments, the inlet 252 may extend into the cavity 382 towards the central duct 376. For example, the inlet 252 may contact an outer wall of the central duct 376 to enhance impingement and vertical flow inside the cavity 382.

In some embodiments, the inlet 252 may be configured to inject fluid (water) into the cavity 382 at least partially azimuthally around the central duct 376 to impart rotation to the fluid in the cavity 382. In various embodiments, the inlet 252 may be oriented at an angle 386 to encourage rotational or azimuthal flow in the cavity. In some cases, such rotation may be substantially circumferentially oriented around the central duct 376, e.g. helical flow moving inwardly towards the common axis (or the inner wall of the cavity 382).

In various embodiments, the angle 386 is formed between a normal to the pipe 374 and/or the body 372, and may be below 90°. In some embodiments, the angle may be substantially between 5-10°, e.g. in some cases, 5° with a 15 GPM flow through the inlet 252.

In some embodiments, the inlet 252 may be rotatable or variably rotatable to achieve better wetting in the wetting head 114 (see rotating motion indicated by double-headed arrow 251). For example, a variable degree angle (such as along the double-headed arrow 251) may increase vortex action inside the wetting head 114 resulting in water climbing up higher and faster to form a vortex in the wetting head 114.

The duct 254 may be disposed a height 388 above the slit 380. The height 388 may be configured to provide sufficient speed to chemicals flowing from the duct 254 into the central duct 376 as they approach the slit 380. For example, the speed may be adapted to achieve a desired interaction between fluid flow (emerging) from the slit 380 and the chemicals from the duct 254. In various embodiments, the height 388 may be 7.5 inches, or between 4-20 inches A diameter 390 of the central duct 376 may be adapted to receive the flow of chemicals from the duct 254, fluid flow from the slit 380, and/or hydrated chemicals fall through the central duct 376. In various embodiments, the diameter 390 may be substantially 3 inches, or between 2-12 inches.

In some embodiments, the wetting head 114 may can deliver 158 lb/min of chemical (weight of dry product) with a 10-15 GPM of water flow through the inlet 252. For example, in some embodiments, a total of 283 lb/min may pass through the central duct 376.

In various embodiments, the wetting head 114 may be supplied gas flow 391 thereinto. The gas flow 391 may be injected into the upper portion 373 of the wetting head 114. The gas flow 391 may be injected onto chemical granules flowing into the wetting head 114 from the duct 254. In various embodiments, the gas flow 391 may be substantially comprised of non-reactive or inert gases, e.g. nitrogen. In some embodiments, a cap may be disposed or coupled on top of the wetting head 114 to prevent gas from the gas flow 391 from escaping outwardly from the wetting head 114. The cap may be configured to receive gas flow 391 via a gas duct coupled to the wetting head 114 via the cap.

In various embodiments, gas flow 391 may prevent premature moisture absorption by chemical granules to enhance wetting of chemical by interaction with water emerging from the slit 380. This may be particularly true for oxidants and other chemicals used for cleaning laundry, as these may be moisture-absorbent. Premature moisture absorption may lead to the chemical granules adopting a semi-solid texture or may encourage coagulation, which may prevent effective mixing, dissolution, and/or wetting of chemical in water.

Figure 4A:
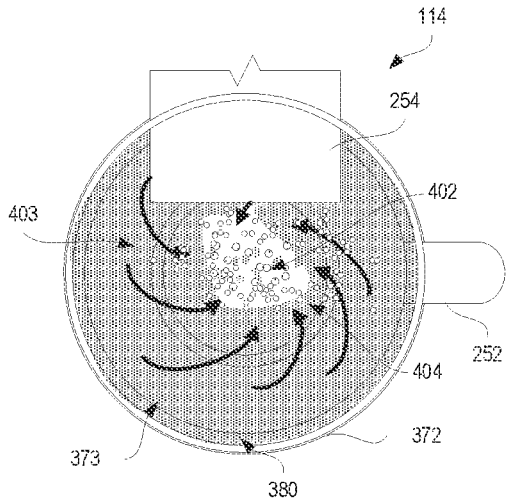
FIG. 4A is a top plan view of a wetting head in operation, in accordance with an embodiment.

FIG. 4A is a top plan view of the wetting head 114 in operation, in accordance with an embodiment.

Figure 4B:
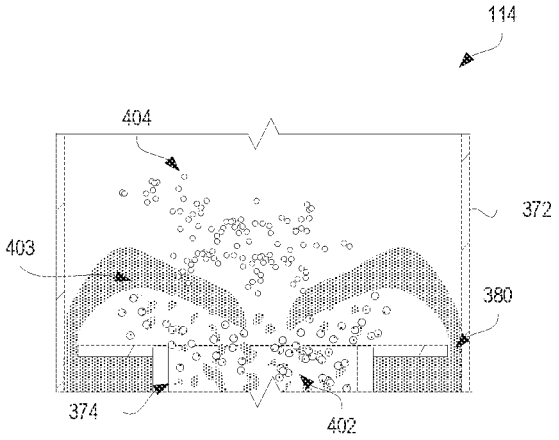
FIG. 4B is a cross-sectional view of the wetting head in operation.

FIG. 4B is a cross-sectional view of the wetting head 114 in operation, in accordance with an embodiment.

Fluid flowing through the slit 380 into the upper portion 373 may form a fluid sheet 403 extending into the upper portion 373. For example, the passage may be configured to form a sheet of water (or sheet of solvent). The fluid sheet 403 may form a substantially annular surface extending from the slit 380 and surrounding the central duct 376. The fluid sheet 403 extends at least partially vertically upward to fall into the central duct 376.

The fluid sheet 403 may bend and then fall into the central duct 376. The fluid sheet 403 or sheet of water may at least partially occlude the central duct 376. Chemical 404 in the form of granules may flow from the duct 254 via the chemical inlet 255 to pass through the fluid sheet 403 (or sheet of solvent or water) occluding the central duct 376 to form a granular flow of wetted chemical 402 and to wet the chemical as the chemical passes through the central duct 376 and out of the outlet 370.

For example, as the fluid sheet 403 may be occluding the central duct 376, the chemical 404 may break the fluid sheet 403 to enter the central duct 376. The breakage process may involve collision of chemical 404 with the fluid sheet 403 at an angle. The extensive shape of the fluid sheet 403 may encourage full and substantial contact between the fluid sheet 403 and the chemical 404. The breakup of the fluid sheet 403 by the chemical 404 encourages mixing in the tank 116, enhances wetting of granules, and prevents clumping. Formation of hydrated granules of chemical may be facilitated.

The heavy-weight arrows in FIG. 4A show a direction of flow of the fluid emerging from the slit 380. In various embodiments, the flow may be in rotation. The inlet 252 may be configured to impart rotation around the central duct 376 to the fluid or water flowing into the central duct 376. The rotational flow may facilitate mixing of the chemical and water, and enhance intermingling of the chemical 404 and the fluid.

Figure 5A:
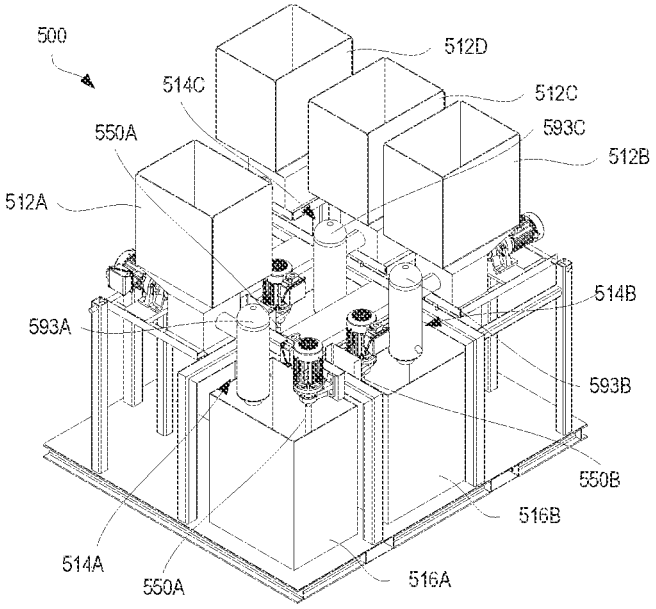
FIG. 5A is a perspective view of a system for delivering washing solutions, in accordance with an embodiment.

FIG. 5A is a perspective view of a system 500 for delivering washing solutions, in accordance with an embodiment.

Figure 5B:
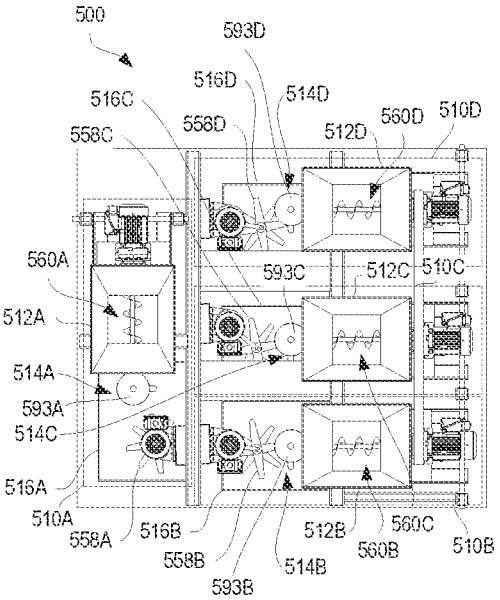
FIG. 5B is a top plan view of the system.

FIG. 5B is a top plan view of the system 500 for delivering washing solutions, in accordance with an embodiment.

In some embodiments, the system 500 is part of an industrial laundry system. In some embodiments, the system 500 is a system for delivering washing solutions to a plurality of washing machines.

The system 500 may comprise (four) chemical stations 510A, 510B, 510C, 510D. In various embodiments, the system 500 may include more or less chemical stations. In some embodiments, the system 500 may comprise liquid chemical or pumping stations. For example, in some embodiments, the system 500 may comprise an additional four liquid pumping stations for a total of eight separate chemical stations. Each chemical station 510A, 510B, 510C, 510D may adapted for a different chemical. In some embodiments, one or more of the chemical stations 510A, 510B, 510C, 510D may prepare and dispense the same chemical, e.g. for capacity.

Each chemical station 510A, 510B, 510C, 510D may have a respective container 512A, 512B, 512C, 512D holding the corresponding chemical. Augers 560A, 560B, 560C, 560D may draw the respective chemicals out of the containers 512A, 512B, 512C, 512D for wetting and mixing with water.

In various embodiments gas may supplied to the wetting heads 514A, 514B, 514C, 514D via respective gas caps 593A, 593B, 593C, 593D, which may have openings therein for receiving gas flow, e.g. nitrogen gas flow for nitrogen blanketing.

The respective chemicals may be wetted with solvent (e.g. water) in corresponding wetting heads 514A, 514B, 514C, 514D before deposition into the respective tanks 516A, 516B, 516C, 516D. The solutions in the respective tanks 516A, 516B, 516C, 516D may be kept mixed by corresponding agitators 550A, 550B, 550C, 550D having agitator blades 558A, 558B, 558C, 558D rotatably driven by electric motors.

For example, tank 516A may hold an oxidant solution including an oxidant chemical, and may be substantially free of surfactants (and other chemicals). Similarly, the tank 516D may hold a surfactant solution including a surfactant, and may be substantially free of oxidant chemicals (and other chemicals). For example, in some embodiments, the tank 516B may be configured to hold an alkali solution including an alkali, and substantially free of oxidant and/or surfactant chemicals.

In various embodiments, the tank 516A may be configured to fluidly connect to the washing vessel 122 to supply the oxidant solution to a washing vessel 122 of a washing machine 120, the tank 516D may be configured to fluidly connect to the washing vessel 122 to supply the surfactant solution to the washing vessel 122, and the tank 516B may be configured to fluidly connect to the washing vessel 122 to supply the alkali solution to the washing vessel 122.

In various embodiments, flows of such solutions may be selectively controlled using one or more fluid devices, such as valves and/or pumps.

In some embodiments, the solutions in the respective tanks 516A, 516B, 516C, 516D may be supplied to the washing vessel 122 via a common chemical solution line. Chemical solutions in the respective tanks 516A, 516B, 516C, 516D may be pumped or flushed into the common chemical solution line. The common chemical solution line may be configured to have water or solvent flowing therein to causing mixing of water or solvent with chemical solutions during pumping or flushing. In some embodiments, chemical solutions may be pumped into the common chemical solution line using one or more electrical pumps, e.g. one pump for each tank 516A, 516B, 516C, 516D.

In some embodiments, the common chemical solution line may be a bypass flow line of a primary water line configured to supply the washing vessel 122. The bypass flow line may receive (a portion of the) water from an upstream position of the primary water line, mix the water with chemical solutions by fluidly connecting to the tanks (tanks 516A, 516B, 516C, 516D), and then supply the mixed water and chemical solutions to a downstream position of the primary water line. In some embodiments, the primary water line may have a diameter double that of the common chemical solution line. For example, the primary water line may have diameter 1 inch and the common chemical solution line may have a diameter of 0.5 inches. In some embodiments, the common chemical solution line may deliver fluids at 0.3 GPM to the downstream position. In some embodiments, flow rates in the primary water line upstream of the bypass flow line may be 15 GPM or less and flow rates of mixed water and solution delivered to the washing vessel may be 28 GPM. The additional flow may arise due to pumping of chemical solutions into the primary water line by electrical pumps.

In various embodiments, flowmeters may be used to track and confirm delivery of chemical solutions to primary water line. For example, in some embodiments, flowmeters may be fluidly connected to the common chemical solution line at a flow location upstream of the injection of chemical solutions and at a flow location downstream of the injection of chemical solutions to allow comparison of flow rate. Such a comparison may provide an indication of delivery of chemical solutions, and quantity thereof. In some embodiments, fixed orifice devices may be used to achieve fixed flow rates to the primary water line. In some embodiments, variable flow regulators with a 4-20 mA control may be used to vary flow rate to achieve faster flushing of chemical solutions and/or delivery to the washing vessel 122.

In some embodiments, additional components not shown in FIG. 5A and FIG. 5B may be used to provide structural integrity.

Figure 6:
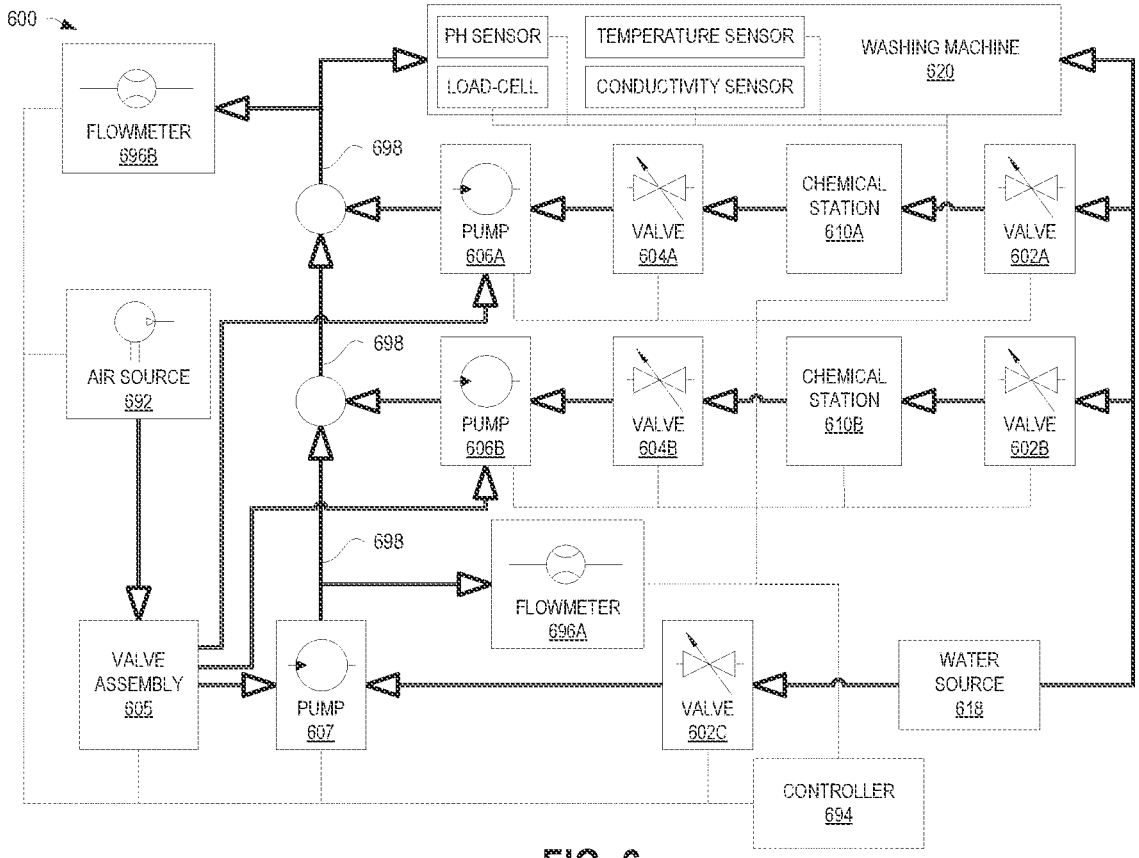
FIG. 6 is a schematic block diagram of an industrial laundry system.

FIG. 6 is a schematic block diagram of an industrial laundry system 600.

The industrial laundry system 600 may incorporate a system for delivering washing solutions to a washing machine 620 having a washing vessel holding laundry for cleaning. In some embodiments, the washing machine 620 may refer to more than one washing machine.

The industrial laundry system may include a first chemical station 610A and a second chemical station 610B for controllably supplying chemical (or washing) solutions to the washing machine 620 via a valve 604A coupled to a pump 606A and a valve 604B coupled to a pump 606B, respectively. Water from a water source 618 is controllably supplied to the first chemical station 610A and the second chemical station 610B via a valve 602A and a valve 602B, respectively, for mixing chemical solutions. In various embodiments, the valves 602A, 602B may be solenoid valves and the valves 604A, 604B may be butterfly valves. In some embodiments, piston valves may be provided.

The pumps 606A, 606B may be connected to an air source 692 via a valve assembly 605 configured to selectively control supply of air to the pumps 606A, 606B. In various embodiments, the air source may be ambient air, a compressor, a compressed air tank, or an accumulator. The air from the air source 692 may be used to provide motive force for pumping fluids, aerate fluids (water and/or chemical solutions), and/or pressurize fluid lines. In some embodiments, air may be supplied to wetting heads to maintain dryness of granular chemicals and prevent chemical reactions.

For example, the first chemical station 610A may deliver a saturated solution of oxidant chemicals with solid oxidants dissolved therein, and the second chemical station 610B may deliver a surfactant solution.

A primary water line 698 may be used to provide water from the water source 618 to the washing machine 620. For example, the water source 618 may be a city water supply. In various embodiments, the primary water line 698 may have water flowing therein at a flow rate greater than 15 GPM In some embodiments, check valves such as ball valves may be disposed along flow lines leading from the chemical stations 610A, 610B to the primary water line 698 to prevent backflow to the respective chemical stations 610A, 610B. In some embodiments, check valve may be disposed immediately upstream and/or downstream of the pumps 606A, 606B. In some embodiments, piston valves may be provided.

In some embodiments, flowmeters may be disposed along flow lines leading from the chemical stations 610A, 610B to the primary water line 698, or along the primary water line 698 (immediately) downstream of junctions between such flow lines and the primary water line 698, to provide confirmation or proof of delivery of chemical solutions. Such proof of delivery may provide detailed flow information of chemical solutions from each of the chemical stations 610A, 610B to the primary water line 698.

A pump 607 may be configured to draw water from the water source 618 into the primary water line 698, via a valve 602C. In some embodiments, the water source 618 may have a pressure head between 60-80 psi. In some cases, the pressure head may be used to draw the water into the system without using the pump 607.

The valve 602C may allow water to be controllably supplied to the washing machine 620 via the primary water line 698. The pump 607 may be connected to the air source 692 via the valve assembly 605 to selectively receive air from the air source 692.

Chemical solutions from the chemical stations 610A, 610B may be supplied to the washing machine 620 via the primary water line 698. For example, the chemical solutions may be flushed thereinto. The water may provide conveyance to the chemical solutions from the chemical stations 610A, 610B.

Providing delivery of water and chemical solutions via one or more common flow lines may facilitate faster and/or more efficient operation of the washing machine 620. For example, supplying chemical solutions via the primary water line 698 simultaneously with water may reduce a need to rinse the flow lines after flow of chemical solutions, since concentration of chemical solutions may be lower in the primary water line 698. Supplying fluids to the washing machine 620 in a sequential manner may be slower than mixing and supplying all the chemical solutions at once. Additionally, the water media may prevent reactions of incompatible chemicals. For example, waiting times may be reduced, with a commensurate impact on costs of washing.

In some embodiments, a duration of time between a chemical solution entering the primary water line 698 and reaching a washing vessel may be sufficiently small to prevent equilibration of solutes in the more dilute chemical solution regime established by ingress of the chemical solution into the primary water line 698. For example, in some embodiments, at least some solid particles suspended in a saturated chemical solution may become thermodynamically susceptible to go into solution once injected into the primary water line 698. However, some portion of these solid particles may not go into solution by the time they encounter laundry due to relatively fast conveyance to the washing vessel via the primary water line 698.

Flowmeters 696A, 696B may be connected to the primary water line 698. The flowmeter 696A may be connected to the primary water line 698 prior to ingress of any chemical solutions therein. The flowmeter 696B may be connected to the primary water line 698 after ingress of all chemical solutions therein, or immediately prior to entering the washing machine 620. The flowmeters 696A, 696B together may be used to measure and confirm product (chemical solution) delivery to the washing machine 620. As described earlier, confirmation of delivery may be achieved by flowmeters measuring flow into and out of the common chemical solution line. Flowmeters may include volumetric flowmeters. In some embodiments, flowmeters may include velocity measurements devices and/or pressure gauges.

A controller 694 may be operably coupled to the valves 602A, 602B, 604A, 604B, and the pumps 606A, 606B, 606C to control the supply of water and chemical solutions to the washing machine 620. The controller 694 may also be operably coupled to the washing machine 620 and to components disposed therein, and the chemical stations 610A, 610B. For example, the washing machine 620 may be equipped with load-cell(s) (and/or other load sensing devices), pH sensor(s), ORP (oxidation reduction potential) sensor(s), TSS (total suspended solids) sensor(s), NTU (national turbidity units), temperature(s), and/or conductivity sensor(s), which may be operably coupled to the controller 694.

In various embodiments, the pH and/or ORP sensor(s) may generate measurement signals indicative of, or related to, respectively, alkali and oxidizer usage in the washing machine 620. In some cases, such sensor(s) may generate measurement signals indicative of soils having pH and/or ORP variations or profiles.

In some embodiments, pH and/or ORP measurements may be used to determine type and quantity of soil on textiles (or "soil loading"). In some embodiments, soil loading may be used to determine dosing and types of chemical solutions to be supplied to the washing machine 620, e.g. via the controller 694. For example, certain chemicals in washing solutions may leave a pH and/or ORP signature when removing soils from textiles. For example, a heavy soil load may generate a greater difference relative to base pH and/or ORP. A soil loading may be determined by comparing pH and/or ORP measurements to base pH and/or ORP.

In some embodiments, pH and/or ORP measurements may be used to track and/or verify chemicals delivered to the washing machine 620. For example, each chemical solution may have a specific pH and/or ORP profile, which may be detected when the chemical solution is supplied to the washing machine 620 (or a washing vessel thereof).

In some embodiments, pH and/or ORP measurements may be used to achieve better performance of chemical solutions, e.g. via feedback control using the controller 694. For example, some chemical solutions may perform more effectively in certain operating envelopes, including pH and/or ORP ranges. Controlling pH and/or ORP in the washing machine 620 to ensure chemical solutions are operating such operating envelopes may reduce wastage (or dosing of chemicals) and improve cleaning performance. In some embodiments, alkali and/or oxidizer may be supplied from one or more chemical stations 610A, 610B to adjust, respectively, pH and/or ORP to achieve better performance of chemical solutions. For example, alkali and/or oxidizer may be supplied based on pH and/or ORP measurements, respectively.

In some embodiments, pH and/or ORP measurements may used to ensure adequate sanitization. For example, microorganisms (e.g. bacteria) may consume oxidizer. In various embodiments, supply of oxidizer to the washing machine 620 may be increased to compensate for such consumption of oxidizer, e.g. the controller 694 may receive measurements of ORP and supply oxidizer to the washing machine 620 based on the measurements (feedback control).

In various embodiments, the conductivity sensor(s) may generate conductivity measurement signals indicative of soil loading. For example, high (electrical) conductivity in water may indicate high levels of TDS (Total Dissolved Solids). For example, each material, chemical, solution or contaminate may have a set measurable conductivity. Measuring the conductivity of washing fluid may indicate soil loading, e.g. by comparing the conductivity to conductivity in clean water and textiles.

In various embodiments, conductivity measurements may be used to track cleaning effect of chemical solutions. For example, each chemical solution may have a conductivity (such as sanitizers, which may be cationic) which may change due to reaction with textiles/soils during a cleaning process. In various embodiments, the controller 694 may adjust dosage of chemical solutions based on soil loading and cleaning effect of chemical solutions. For example, the conductivity of washing fluids during a final rinse stage of the washing process may be tracked to ensure sufficient dosing of sanitizer, in order to achieve complete sanitization. In some cases, complete sanitization may be a cleaning requirement.

In various embodiments, temperature measurements from the temperature(s) may be used in a feedback loop by the controller 694 to control injection of chemical solutions into the washing machine 620 to achieve better cleaning and sanitization (including sterilization). For example, chemical activation, rheology of chemical solutions and soils, catalytic behaviour of chemicals, and viability of microorganisms may each or all be dependent on temperature. In various embodiments, such factors may be at least partially controlled by controlling temperature in the washing machine 620, e.g. using the controller 694. For example, temperature may effect flowability of animal fats. As another example, effective sterilization may be achieved by providing verifiable application of elevated temperature to kill microorganisms and denature organic material like viruses. In some cases, such verifiability may help achieve regulatory standards for hospital sanitization.

In various embodiments, the TSS and/or NTU sensor(s) may be used to determine soil loading. TSS and NTU tests are key tests of water quality and may reflect suspended soils in the cleaning solvent. For example, in some jurisdictions, the drinking Municipal Standard for tap water is <10 TSS and <10 NTU. Comparing TSS and NTU measurements to base TSS and NTU value may provide an indication of soil loading. In some cases, using TSS and NTU in a final rinse stage may provide proof of cleaning for textiles. For example, proof of cleaning may demonstrate that textiles are free of residuals from the cleaning process. This may be particularly relevant for hypoallergenic sanitization of textiles.

In various embodiments, sensors may be used to track laundry as it moves through a wash cycle in the washing machine 620. The sensors may facilitate of obtaining proof of delivery of chemical solutions and proof of cleaning (e.g. including sanitization).

In various embodiments, one or more sensors and/or actuators may be disposed in a washing vessel of the washing machine 620. In some embodiments, a separate chamber (or sampling station) fluidly connected to the washing vessel of the washing machine 620 may be configured to draw in washing fluids from the washing vessel for testing therein. For example, in some cases, existing washing machines may be retrofitted with such sampling stations, which may come pre-equipped with a sensor suite, at significantly reduced cost savings, relative to replacing the existing washing machines. After testing, the sampling station may expel washing fluids back into the washing vessel of the washing machine 620 or otherwise drain such fluids. In various embodiments, flow into and out of the sampling station may be controlled via passive or active valves, and/or other types of flow device(s).

In some embodiments, the sampling station may be configured to draw in fluids from the primary water line 698 to test various properties of incoming washing fluids. In some embodiments, the sampling station may be configured to draw in fluids from a drainage line or wastewater line of the washing machine 620 (not shown).

As mentioned above, the controller 694 may utilize various measurements from the sampling stations to control supply of chemical solutions and water to the washing machine 620, e.g. based on (inferred or determined) soil conditions of the laundry, the composition of washing fluids and/or wastewater, and/or chemical/physical properties of the washing fluids and/or wastewater.

The controller 694 may be operably coupled to augers of the chemical stations 610A, 610B and/or level sensors in tanks of the chemical stations 610A, 610B.

For example, in some embodiments, the controller 694 may receive a signal indicative of a soil condition of the laundry. Based on this signal, the controller 694 may be configured to cause supply of chemical solutions to a washing vessel of the washing machine 620. For example, the soil condition may indicate a soil type and/or a soil quantity. In some cases, a soil condition may be indicated by a type of solution and quantity thereof to be used.

In some embodiments, a level sensor in a chemical station may indicate, to the controller 694, the start of a process to produce a volume of chemical solution with a given concentration. In some embodiments, an operator or user may indicate the volume of chemical solution and/or the concentration.

In some embodiments, the controller 694 may then operate a valve to draw water through a 1-inch flowmeter to the relevant chemical station. In various embodiments, the water flow may be limited to a 15 GPM flow rate, e.g. using fixed orifice device. In some embodiments, the controller 694 may the turn on the auger to provide a fixed feed rate at 0.54 lbs per RPM. The RPM may be determined based on the (required) amount of chemical in the chemical solution.

In some embodiments, the controller 694 may monitor the amount dry chemical feedstock in a container of a chemical station by using a load-cell therein. In some embodiments, the controller 694 may provide a confirmation of product delivery to the washing machine 620 by using load-cells measuring the load on washing vessels. In some embodiments, the controller 694 may monitor the flowmeters 696A, 696B to track the delivery of water and chemical solutions to ensure necessary amounts of air and water for proper operation are supplied.

In various embodiments, the controller 694 may supply information regarding product delivery, flowrates in flow lines, and/or status of chemical solution production to a user and/or operator. For example, this may facilitate detection of errors and mechanical failures by an operator. For example, an operator may intervene to override controller operations.

Figure 7:
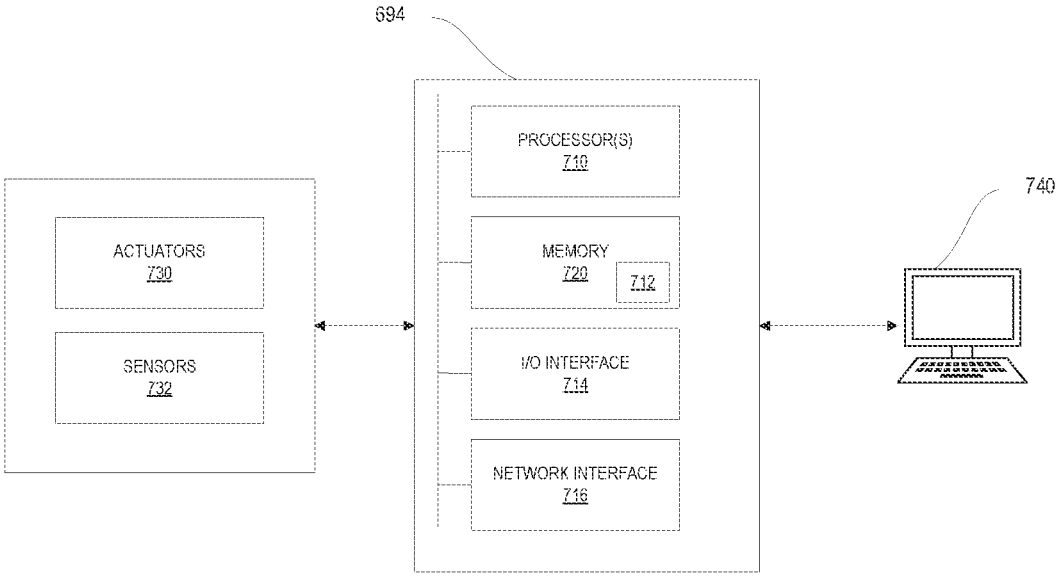
FIG. 7 is a schematic diagram showing a controller, in accordance with an embodiment.

FIG. 7 is a schematic diagram showing the controller 694, in accordance with an embodiment.

The controller 694 may comprise computer-readable memory 712 having instructions 720 stored thereon. The instructions 720 may be configured to cause one or more processors 710 to execute one or more methods.

For example, the instructions 720 may be configured to control cleaning of laundry based on inputs from sensors 932, e.g. flowmeters and load-cells. The controller 694 may be configured to control cleaning in more than washing machine and/or using one or more chemical stations.

In various embodiments, the controller 694 may be configured to command actuators 730 to control one or more fluid devices to supply chemical solutions to washing vessels. For example, the controller 694 may command pumps and flow valves, agitators, and/or power provided to electric motors to operate an auger.

In some embodiments, the controller 694 may comprise an I/O interface 714 or an interface adapter for one or two-way communication of the controller 694 with one or more other (external) components. In some embodiments, a terminal and/or graphical user interface (GUI) 740 may be connected to the controller 694. The controller 694 may be controlled and/or adapted by an operator via the terminal or the GUI 740. In some embodiments, the controller 694 may comprise a network interface 716, e.g. to communicate with the terminal, the sensors 732 and/or the actuators 730, or connect to local area network, wide area network, and/or the internet.

In some embodiments, sensors 732 may include load-cell(s) for measuring a washing load, e.g. weight of laundry (including or without water). In some embodiments, sensors 732 may include a pH sensor for measuring the pH of the laundry (water, textiles and/or both together). In some embodiments, sensors 732 may include a conductivity sensor for measuring electrical conductivity of the laundry (water, textiles and/or both together). In some embodiments, sensors 732 may include a temperature sensor for measuring temperature of the laundry (water, textiles and/or both together).

In some embodiments, the controller 694 may be configured to control supply of chemical solutions to the washing machine 620 based on input from one or more the sensors 732. In some embodiments, the controller 694 may be configured to control chemical stations 610A, 610B based on input from one or more of the sensors 732. For example, one or more of the sensors 732 may be used to determine a soil condition of the laundry, e.g. soil type and soil quantity, which may be used to determine the type and quantity of chemical solution prepared and supplied to the washing machine 620 via the chemical stations 610A, 610B.

Figure 8:
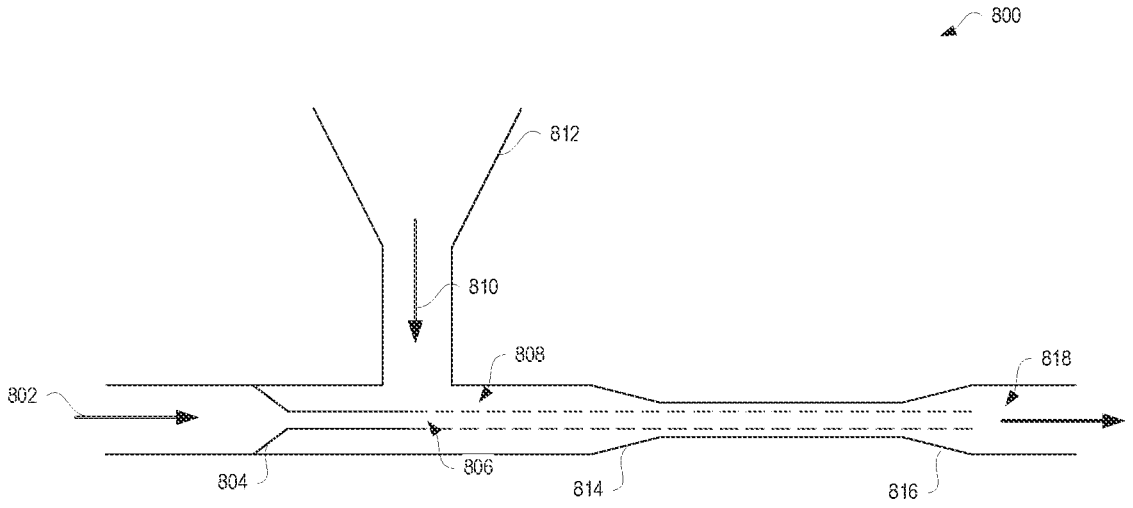
FIG. 8 is a schematic diagram of a flow eductor wetting head.

FIG. 8 is a schematic diagram of a flow eductor wetting head 800. In some embodiments, the wetting head 800 may be used in chemical stations for wetting granular chemical before deposition in a tank (e.g. of one of the chemical stations 610A, 610B), a washing vessel of the washing machine 620, or the primary water line 698.

A granular flow 810 of chemical may issue from a container 812 into a mixing plenum 808 to be received therein. A flow 802 of solvent (e.g. water) may enter the wetting head 800 at one end. The flow 802 of solvent may be accelerated using a converging nozzle 804 (or section) to form a jet 806 (of accelerating or high speed fluid) issuing into a mixing plenum 808 (or entrainment plenum) to wet the chemical in the mixing plenum 808. For example, the granular flow 810 may issue into the mixing plenum 808 at least partially lateral to the flow 802 of solvent.

Turbulence and entrainment of adjacent fluids and granular materials may result. For example, in some embodiments, a low-pressure zone may be established in the mixing plenum 808, or downstream thereof, which may act as a pump for drawing granular chemicals into the mixing plenum 808. Fluid may shoot into the mixing plenum 808 at high velocity, creating an entrainment effect (suction or induction) to draw in the granular flow 810 for wetting.

A second converging nozzle 814 (or section), followed by a diverging section 816 (or diffuser), may be disposed downstream of the mixing plenum 808. The second converging nozzle 814 may be fluidly connected to the mixing plenum 808 to receive the chemical and the solvent from the mixing plenum 808 after wetting of the chemical. Wetting of chemical may also include partial wetting of chemical.

The diffuser 816 may be fluidly connected to the second converging nozzle 814 to receive the chemical and the solvent therefrom. The diverging section 816 may open to a second mixing plenum 818, wherein further turbulence and mixing may occur. Low-pressure in the second mixing plenum 818 may draw fluid and granular chemical through the wetting head 800. Turbulence, separation, and flow stagnation may facilitate wetting of granules and mixing of chemical and water.

In various embodiments, backflow may prevented in the flow eductor wetting head 800. For example, in some embodiments, check valves may be disposed upstream and downstream of the flow eductor wetting head 800. In some embodiments, anti-syphon pressure regulators may be disposed upstream of the flow eductor wetting head 800 and swing check valves may be disposed down stream of the flow eductor wetting head 800.

In some embodiments, the flow eductor wetting head 800 may facilitate direct injection of chemical solutions into a flow line to supply chemical solutions to the washing machine 620. In some embodiments, the flow eductor wetting head 800 may be operably connected to the primary water line 698 or a common chemical solution line, which may supply the flow 802 of solvent.

In some embodiments, the flow eductor wetting head 800 may be used without tanks and may be connected directly to a source of chemical powder (such as a hopper). In some embodiments, the flow eductor wetting head 800 may act as a pump and/or may replace pumps, e.g. diaphragm pumps used to pump chemical solutions.

Figure 9A:
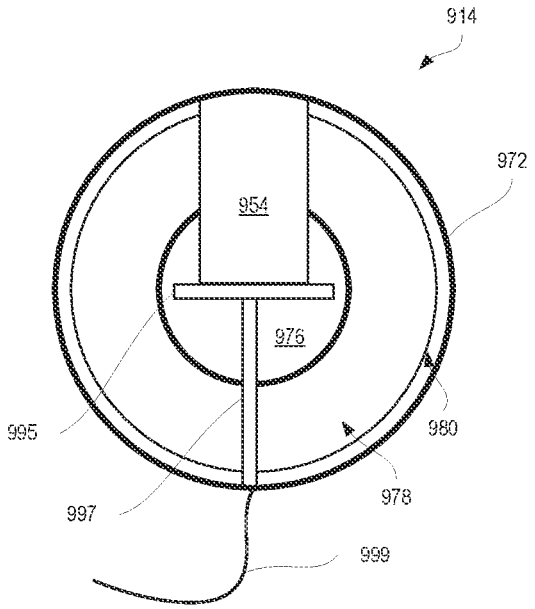
FIG. 9A is a top plan view of a wetting head with a duct blocked off, in accordance with an embodiment.

FIG. 9A is a top plan view of a wetting head 914 with a duct 954 blocked off, in accordance with an embodiment.

Figure 9B:
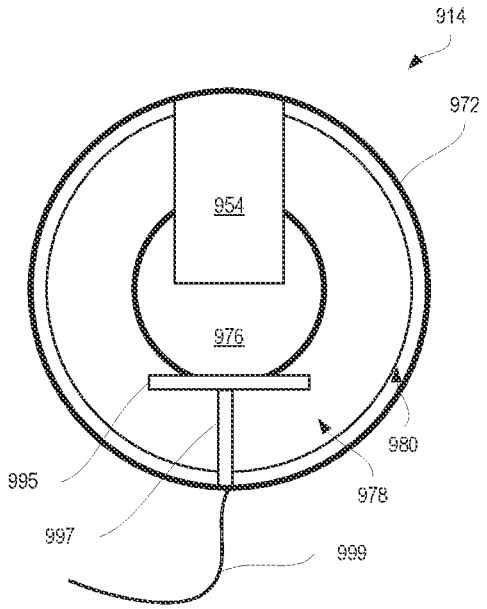
FIG. 9B is a top plan view of the wetting head with the duct open.

FIG. 9B is a top plan view of the wetting head 914 with the duct 954 open.

The wetting head 914 may be compared to the wetting head 114 in FIGS. 3A-3C, with parts labeled with corresponding reference numbers where applicable; the last two digits of reference numerals in FIG. 9A-9B correspond to the last two digits of reference numerals in FIGS. 3A-3C The wetting head 914 comprises a body 972 defining a space for receiving granular flow of chemicals via the duct 954. Fluid (water or other solvent) flow from a cavity below a flange 978 passes through a passage 980 to form a (vertical) fluid sheet. The granular flow impinges on the fluid emerging the passage 980 and then flows, together with fluid, into a central duct 976 for delivery to a washing vessel. Impingement of the granular flow on the fluid wets chemical granules, e.g. by break or atomizing the fluid sheet.

In various embodiments, fluids and ambient may lead to spoilage of chemicals in the duct 954, and any container of chemical container or container connected thereto, before they exit therefrom. For example, premature hydration of chemicals may lead to poor chemical and material properties for mixing and interaction with the solvent. In some cases, chemicals may undesirably adopt liquid or sludge-like consistency if not protected from moisture absorption.

In some embodiments, a gas blanket of dry and/or non-reactive air may be generated in the body 972 to prevent premature hydration and/or chemical reactions of chemical granules. In some embodiments, a desiccant may be provided in the duct 954, the container and/or locations fluidly exposed to the chemicals (chemical granules).

In some embodiments, the duct 954 may comprise a plate 995 for sealing the duct 954 to prevent ingress of moisture and/or reactive gases into the duct 954 and/or the container. For example, the plate 995 may be used to prevent moisture absorptive chemicals from turning to liquids due to moisture in air.

The plate 995 may be operable via a shaft 997. For example, the shaft 997 may be actuated by the controller 694 to seal the duct 954. In some embodiments, the plate 995 may be a pressurized plate. For example, the shaft 997 may comprise components for applying a force onto the plate 995 to achieve sealing.

In some embodiments, movement of the shaft 997 may be controlled via pressurized air provided via an air supply 999. In some embodiments, pressurized air may be used to apply pressure directly onto the plate 995 for pressurization to seal off the duct 954.

In some embodiments, when a chemical station is not producing chemical solutions, e.g. flow and wetting of chemical granules is not needed, the pressurized plate 995 adopts a closed position show in FIG. 9A to seal the duct 954. In some embodiments, when a chemical station is to produce chemical solutions, the pressurized plate 995 may be released into an open position shown in FIG. 9B to open the duct 954.

Figure 10:
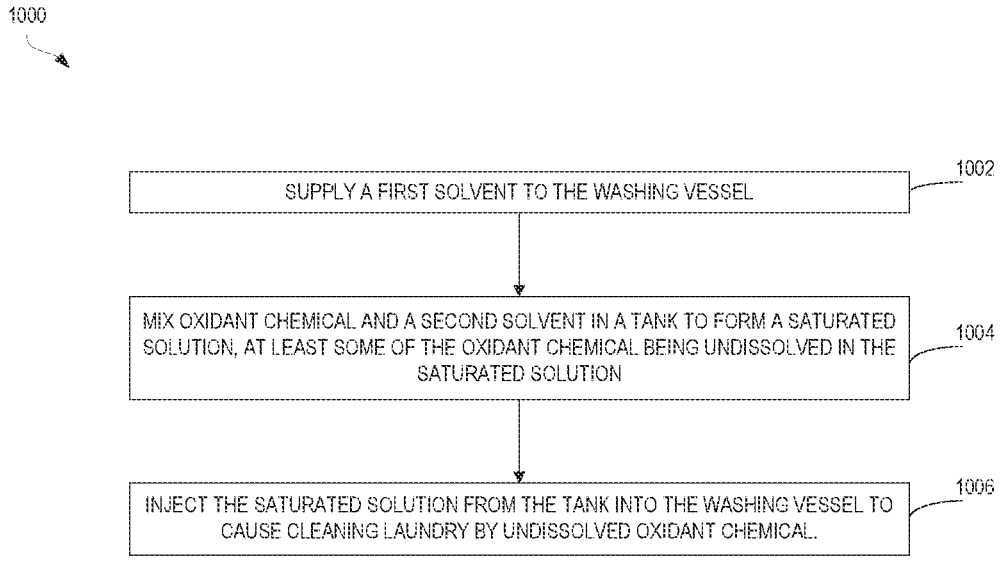
FIG. 10 is a flow chart of a method of cleaning laundry in a washing vessel, in accordance with an embodiment.

FIG. 10 is a flow chart of a method 1000 of cleaning laundry in a washing vessel, in accordance with an embodiment.

Step 1002 may include supplying a first solvent to the washing vessel.

Step 1004 may include mixing oxidant chemical and a second solvent in a tank to form a saturated solution, at least some of the oxidant chemical being undissolved in the saturated solution.

Step 1006 may include injecting the saturated solution from the tank into the washing vessel to cause cleaning laundry by undissolved oxidant chemical.

In various embodiments, a weight of the undissolved oxidant chemical in the saturated solution is greater than a weight of dissolved oxidant chemical in the saturated solution. In various embodiments, the saturated solution is a supersaturated solution. In various embodiments, the oxidant chemical is granular, and the saturated solution is substantially free of builders and surfactants.

Some embodiments of the method 1000 may include forming an ionic surfactant solution separate from the saturated solution, the ionic surfactant solution including an ionic surfactant; forming a non-ionic surfactant solution separate from the saturated solution, the non-ionic surfactant solution including a non-ionic surfactant; and injecting the ionic surfactant solution and the non-ionic surfactant solution into the washing vessel.

In various embodiments, injecting the saturated solution into the washing vessel includes mixing the saturated solution with a third solvent to form a mixed solution; and conveying the mixed solution to the washing vessel.

Some embodiments of the method 1000 may include forming a mixed surfactant solution, the mixed surfactant solution including a non-ionic surfactant and an ionic surfactant, the ionic surfactant being an anionic surfactant; and injecting the mixed surfactant solution into the washing vessel.

In various embodiments, an amount of the ionic surfactant is based on a washing temperature in the washing vessel. In various embodiments, the first solvent is water and an amount of the ionic surfactant is based on hardness of the water.

Some embodiments of the method 1000 may include supplying, to the washing vessel and during a pre-wash stage, citric acid and at least one of sodium bentonite or activated carbon. For example, the citric acid may be 30% citric acid. Reductions in BTX-based emissions may result.

Some embodiments of the method 1000 may include supplying, to the washing vessel and during a pre-wash stage, at least one of sodium bentonite or activated carbon, e.g. without citric acid.

The citric acid, sodium bentonite, and/or activated carbon may be added at the start of the washer as the water is filling in to do the initial wetting of the textiles.

For example, it is found that certain types of activated carbon are particularly suited for solvent absorption. For example, granular activated carbon may be used. For example, the mesh size may be about 4×8: 90% (minimum) (less than no. 4 about 5% (maximum), greater than no. 8 about 5% (maximum)), CCl4 activity about 60% (minimum), iodine no. 1100 mg/g (minimum), hardness no. about 98% (minimum), ash content about 5% (maximum), moisture (as packaged) about 5% (average), typical density about 29-32 lbs/cu-ft (or 0.47-0.50 g/cc). In various embodiments, the activated carbon may be made from selected grades of coconut shell. The activated carbon may have a high activity level and high hardness.

Figure 11A:
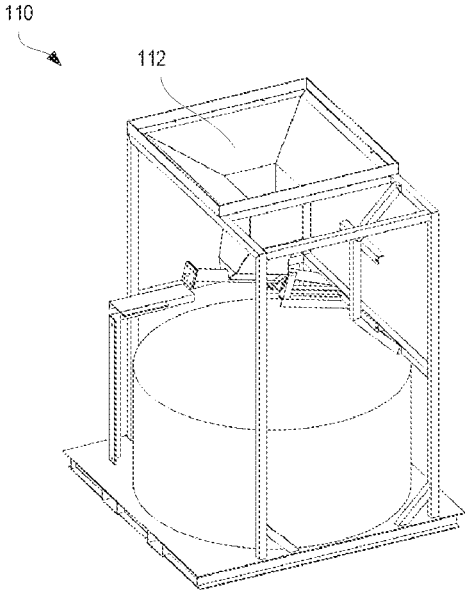
FIG. 11A is a perspective view of a chemical station, in accordance with another embodiment.

FIG. 11A is a perspective view of a chemical station 110, in accordance with another embodiment.

Figure 11B:
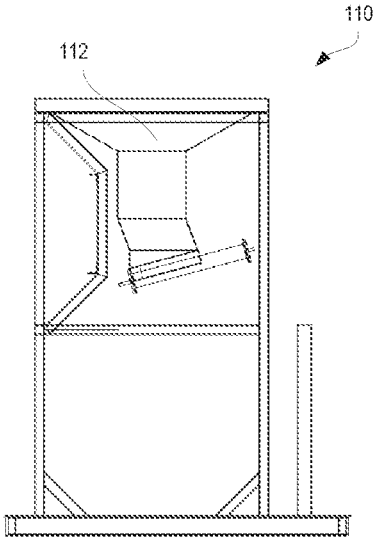
FIG. 11B is a front elevation view of the chemical station of FIG. 11A, in accordance with another embodiment.

FIG. 11B is a front elevation view of the chemical station 110 of FIG. 11A, in accordance with another embodiment.

The chemical station of FIGS. 11A-11B may have a container 112 that is a bag.

As can be understood, the examples described above and illustrated are intended to be exemplary only.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, a solvent other than water may be used for cleaning. Yet further modifications could be implemented by a person of ordinary skill in the art in view of the present disclosure, which modifications would be within the scope of the present technology.

What is claimed is:

1. A method of cleaning laundry in a washing vessel, comprising:

supplying a first solvent to the washing vessel;

selectively mixing oxidant chemical and a second solvent in a tank to form a saturated solution, at least some of the oxidant chemical being undissolved and mixed with the saturated solution to form a mixed solution that is suitable for chemically degrading soils in wastewater generated by the cleaning of the laundry by the mixed solution injecting the saturated solution mixed with undissolved oxidant chemical from the tank into the washing vessel to cause the cleaning of the laundry by the mixed solution and by contact with the undissolved oxidant chemical to generate the wastewater; and causing chemically degradation, by the oxidant chemical in the mixed solution, of soils in the wastewater in the washing vessel.

2. The method of claim 1, wherein a weight of the undissolved oxidant chemical that is mixed in the saturated solution is greater than a weight of dissolved oxidant chemical in the saturated solution.

3. The method of claim 1, wherein the saturated solution is a supersaturated solution.

4. The method of claim 1, wherein the oxidant chemical is granular, and the saturated solution is substantially free of builders and surfactants.

5. The method of claim 1, further comprising:

forming an ionic surfactant solution separate from the saturated solution, the ionic surfactant solution including an ionic surfactant;

forming a non-ionic surfactant solution separate from the saturated solution, the non-ionic surfactant solution including a non-ionic surfactant; and injecting the ionic surfactant solution and the non-ionic surfactant solution into the washing vessel.

6. The method of claim 1, wherein the mixed solution is a first mixed solution and injecting the saturated solution mixed with the undissolved oxidant chemical into the washing vessel includes mixing the saturated solution mixed with the undissolved oxidant chemical with a third solvent to form a second mixed solution mixed with the undissolved oxidant chemical; and conveying the second mixed solution mixed with the undissolved oxidant chemical to the washing vessel.

7. The method of claim 1, further comprising:

forming a mixed surfactant solution, the mixed surfactant solution including a non-ionic surfactant and an ionic surfactant, the ionic surfactant being an anionic surfactant; and injecting the mixed surfactant solution into the washing vessel.

8. The method of claim 7, wherein an amount of the ionic surfactant is based on a washing temperature in the washing vessel.

9. The method of claim 7, wherein the first solvent is water and an amount of the ionic surfactant is based on hardness of the water.

10. The method of claim 1, further comprising:

supplying, to the washing vessel and during a pre-wash stage, citric acid and at least one of sodium bentonite or activated carbon.

11. The method of claim 1, wherein supplying a first solvent to the washing vessel is a first stage of the cleaning of the laundry in the washing vessel, and injecting the saturated solution mixed with undissolved oxidant chemical from the tank into the washing vessel is a second stage of the cleaning of the laundry in the washing vessel.

* * * * *